US011302267B2

(12) United States Patent
Chen et al.

(10) Patent No.: US 11,302,267 B2
(45) Date of Patent: Apr. 12, 2022

(54) LED DISPLAY PANEL HAVING A DRIVER DEVICE FOR EQUALIZING DATA LINES AND OPERATION METHOD THEREOF

(71) Applicant: Novatek Microelectronics Corp., Hsinchu (TW)

(72) Inventors: Chun-Hung Chen, Yunlin County (TW); Chia-Hsin Tung, Hsinchu (TW); Hsin-Hung Ou, Kaohsiung (TW); Hung-Yi Lin, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/123,129

(22) Filed: Dec. 16, 2020

(65) Prior Publication Data

US 2021/0366407 A1 Nov. 25, 2021

Related U.S. Application Data

(60) Provisional application No. 63/027,356, filed on May 20, 2020.

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2300/0443* (2013.01); *G09G 2310/0286* (2013.01)

(58) Field of Classification Search
CPC ..... G09G 3/3291
USPC ..... 345/214
See application file for complete search history.

(56) References Cited

U.S. PATENT DOCUMENTS

| | | | |
|---|---|---|---|
| 7,071,894 | B1 | 7/2006 | Thielemans et al. |
| 10,476,707 | B2 | 11/2019 | Jose et al. |
| 10,678,295 | B2 | 6/2020 | Fu et al. |

(Continued)

FOREIGN PATENT DOCUMENTS

| | | |
|---|---|---|
| TW | 200919419 | 5/2009 |
| TW | 201514951 | 4/2015 |

(Continued)

OTHER PUBLICATIONS

"Office Action of Taiwan Counterpart Application", dated Nov. 5, 2021, p. 1-p. 3.

*Primary Examiner* — Long D Pham
(74) *Attorney, Agent, or Firm* — JCIPRNET

(57) ABSTRACT

A driving device and an operation method thereof are provided. The driver device includes a source driver circuit, an output switching circuit, and an equalization control circuit. Two input ends of the output switching circuit are coupled to two output ends of the source driver circuit. Two output ends of the output switching circuit are coupled to two data lines of an LED display panel. The equalization control circuit checks whether sub-pixel data of the two data lines meets a predetermined condition. A plurality of sub-pixels located on a current display line of the LED display panel are reset in a reset period. In a data scanning period after the reset period, the equalization control circuit determines whether to control the output switching circuit to perform an equalization operation on the two data lines according to the checking result.

18 Claims, 11 Drawing Sheets

(56) References Cited

U.S. PATENT DOCUMENTS

| | | | | |
|---|---|---|---|---|
| 2008/0007504 | A1* | 1/2008 | Kawaura | G09G 3/006 345/89 |
| 2013/0120334 | A1* | 5/2013 | Kim | G09G 3/3688 345/208 |
| 2015/0102989 | A1 | 4/2015 | Lee et al. | |
| 2015/0379909 | A1 | 12/2015 | Yu et al. | |
| 2017/0309219 | A1* | 10/2017 | Kong | G09G 3/2003 |
| 2019/0258287 | A1 | 8/2019 | Fu et al. | |
| 2019/0273639 | A1 | 9/2019 | Jose et al. | |

FOREIGN PATENT DOCUMENTS

| | | |
|---|---|---|
| TW | 201937342 | 9/2019 |
| TW | 201946385 | 12/2019 |

* cited by examiner

LED DISPLAY PANEL HAVING A DRIVER DEVICE FOR EQUALIZING DATA LINES AND OPERATION METHOD THEREOF

CROSS-REFERENCE TO RELATED APPLICATION

This application claims the priority benefit of U.S. provisional application Ser. No. 63/027,356, filed on May 20, 2020. The entirety of the above-mentioned patent application is hereby incorporated by reference herein and made a part of this specification.

BACKGROUND

Technical Field

The disclosure relates to a light-emitting diode (LED) display device, and in particular, to a driver device of an LED display panel and an operation method thereof.

Description of Related Art

The transistor of a sub-pixel circuit of an organic light-emitting display (OLED) panel exhibits the diode property, such that the gate voltage of the transistor may experience voltage overcharging in the data scanning period. When voltage overcharging occurs in the gate voltage of the transistor of the sub-pixel circuit, the voltage of the storage capacitor of the sub-pixel circuit may not follow an output voltage of an output buffer to the target level, leading to abnormal display of the OLED panel.

It should be noted that the contents disclosed in the "Description of Related Art" section is used for enhancement of understanding of the disclosure. A part of the contents (or all of the contents) disclosed in the "Description of Related Art" section may not pertain to the conventional technology known to people having ordinary skill in the art. The information disclosed in the "Description of Related Art" section does not mean that the content is known to people having ordinary skill in the art before the filing of the disclosure.

SUMMARY

The disclosure provides a driver device and an operation method thereof to prevent an overcharging phenomenon caused by an equalization operation.

In an embodiment of the disclosure, the driver device is adapted to drive a light-emitting diode display panel. The driver device includes a source driver circuit, an output switching circuit, and an equalization control circuit. A first input end and a second input end of the output switching circuit are respectively coupled to a first output end and a second output end of the source driver circuit. A first output end and a second output end of the output switching circuit are adapted to be coupled to a first data line and a second data line of the light-emitting diode display panel. The output switching circuit is capable of performing an equalization operation on the first data line and the second data line. The equalization control circuit is configured to check whether sub-pixel data of the first data line and sub-pixel data of the second data line meet a predetermined condition. The equalization control circuit determines whether to control the output switching circuit to perform the equalization operation on the first data line and the second data line in a data scanning period according to the checking result after a reset period. In the reset period, a plurality of sub-pixels of the light-emitting diode display panel located on a current display line of the light-emitting diode display panel are reset.

An operation method provided by an embodiment of the disclosure includes the following steps. An equalization operation is performed on a first data line and a second data line of a light-emitting diode display panel by an output switching circuit of a driver device. Whether sub-pixel data of the first data line and sub-pixel data of the second data line meet a predetermined condition is checked by an equalization control circuit of the driver device. A plurality of sub-pixels of the light-emitting diode display panel located on a current display line of the light-emitting diode display panel are reset in a reset period. Whether to control the output switching circuit to perform the equalization operation on the first data line and the second data line in a data scanning period according to the checking result after the reset period is determined by the equalization control circuit.

To sum up, in the driver device and the operation method thereof provided by the embodiments of the disclosure, the driver device may check whether the sub-pixel data of the first data line and the sub-pixel data of the second data line meet the predetermined condition, so as to further determine whether to perform the equalization operation on the first data line and the second data line according to the checking result. For instance, when the predetermined condition is met, the output switching circuit may perform the equalization operation to reduce the voltage swing caused by the charging and discharging operations performed on the data lines. When the predetermined condition is not met, the output switching circuit does not perform the equalization operation to prevent the overcharging phenomenon from occurring. Therefore, the driver device may prevent the overcharging phenomenon caused by the equalization operation from occurring.

To make the aforementioned more comprehensible, several embodiments accompanied with drawings are described in detail as follows.

DESCRIPTION OF THE EMBODIMENTS

Figure 1:
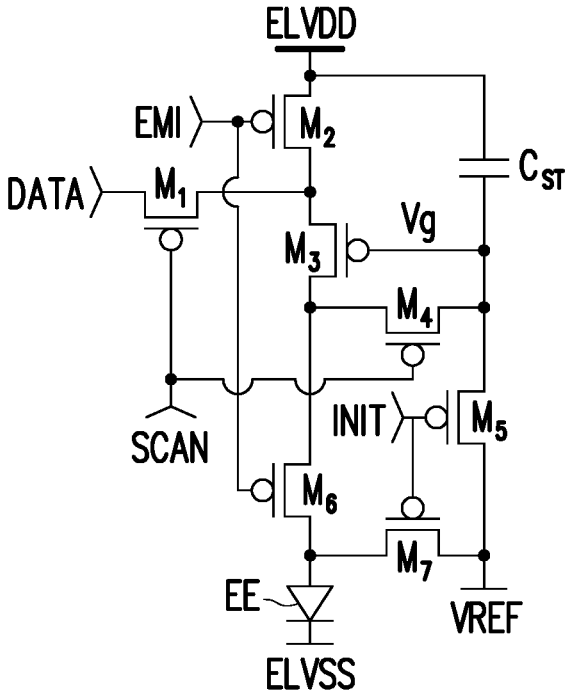
FIG. 1 is a schematic view of a sub-pixel circuit of an organic light-emitting display (OLED) panel.

The term "coupled to (or connected to)" used in the entire disclosure (including claims) refers to any direct or indirect connecting means. For example, if the disclosure describes a first apparatus is coupled to (or connected to) a second apparatus, the description should be explained as the first apparatus that is connected directly to the second apparatus, or the first apparatus, through connecting other apparatus or using certain connecting means, is connected indirectly to the second apparatus. In addition, terms such as "first" and "second" in the entire specification (including claims) are used only to name the elements or to distinguish different embodiments or scopes and should not be construed as the upper limit or lower limit of the number of any element and should not be construed to limit the order of the elements. Moreover, elements/components/steps with the same reference numerals represent the same or similar parts in the figures and embodiments where appropriate. Descriptions of the elements/components/steps with the same reference numerals or terms in different embodiments may be references for one another.

FIG. 1 is a schematic view of a sub-pixel circuit of an organic light-emitting display (OLED) panel. The sub-pixel circuit shown in FIG. 1 includes a transistor $M_1$, a transistor $M_2$, a transistor $M_3$, a transistor $M_4$, a transistor $M_5$, a transistor $M_6$, a transistor $M_7$, a storage capacitor $C_{ST}$, and an emission element EE. A source of the transistor $M_2$ and a first end of the storage capacitor $C_{ST}$ are coupled to an anode voltage ELVDD. Two ends of the emission element EE are respectively coupled to the transistor $M_6$ and a cathode voltage ELVSS. The emission element EE is an organic light-emitting diode. Drains of the transistor $M_5$ and the transistor $M_7$ are coupled to a reference voltage VREF. Levels of the anode voltage ELVDD, the cathode voltage ELVSS, and the reference voltage VREF may be determined according to design needs. Gates of the transistors $M_5$ and $M_7$ are coupled to a reset line of the OLED panel to receive a reset signal INIT. Gates of the transistors $M_1$ and $M_4$ are coupled to a display line of the OLED panel to receive a scan signal SCAN. Gates of the transistors $M_2$ and $M_6$ are coupled to an emission line of the OLED panel to receive an emission signal EMI. A source of the transistor $M_1$ is coupled to a data line of the OLED panel to receive a data voltage DATA.

Parasite capacitor on the data line of the OLED panel is considerably greater than the storage capacitor $C_{ST}$ (approximately 100 to 200 times greater) generally. A decrease in voltage swing of charging and discharging operations performed on the data line may facilitate improvement of power consumption of the OLED panel. In any case, a charge-sharing operation applicable to a liquid crystal display (LCD) panel may not be easily transferred to the OLED panel. If the charge-sharing operation is unconditionally performed on the data line of the OLED panel, the storage capacitor $C_{ST}$ of the sub-pixel circuit may experience voltage overcharging (excessive charging). Based on a structural property of sub-pixel circuit of the OLED panel, once voltage overcharging occurs in the storage capacitor $C_{ST}$, not until the storage capacitor $C_{ST}$ is reset may a voltage of the storage capacitor $C_{ST}$ be pulled back to a target level (a data voltage level corresponding to display data).

Figure 2:
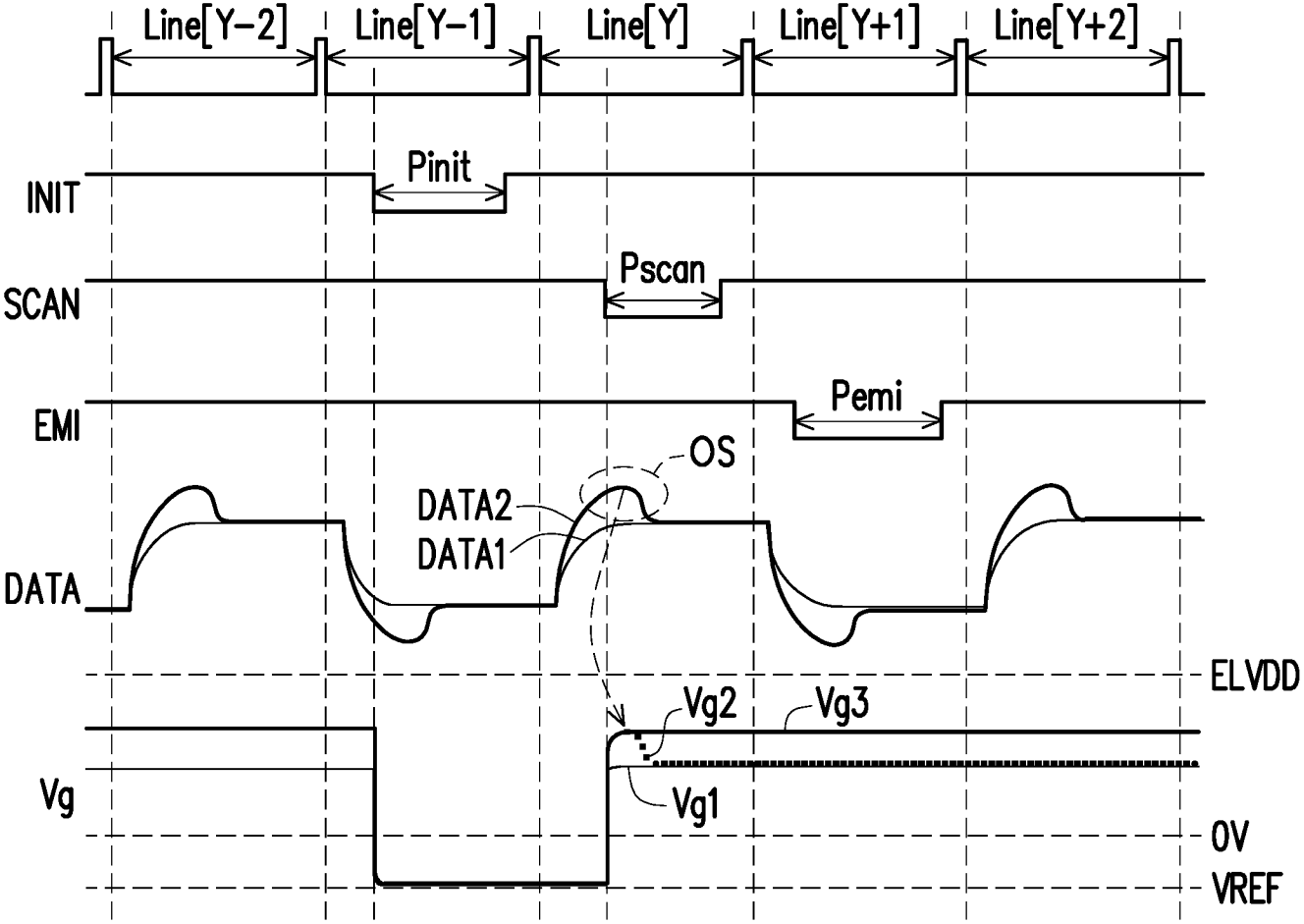
FIG. 2 is a schematic diagram of signal waveforms of the sub-pixel circuit shown in FIG. 1.

FIG. 2 is a schematic diagram of signal waveforms of the sub-pixel circuit shown in FIG. 1. Generally, a driving operation performed by a display driver integrated circuit (DDIC) on an OLED panel is at least divided into three operational periods, namely an initiation period, a data scan period, and an emission period. The horizontal axis shown in FIG. 2 represents time. As shown in FIG. 2, Line[Y−2], Line[Y−1], Line[Y], Line[Y+1], and Line[Y+2] respectively represent horizontal periods of a $Y-2^{th}$ display line, a $Y-1^{th}$ display line, a $Y^{th}$ display line, a $Y+1^{th}$ display line, and a $Y+2^{th}$ display line. The driving operation of the $Y^{th}$ display line is described herein. Description of the driving operations performed on the rest of the display lines (e.g., the $Y-2^{th}$ display line, the $Y-1^{th}$ display line, the $Y+1^{th}$ display line, and the $Y+2^{th}$ display line) may be deduced by analogy with reference to related description of the $Y^{th}$ display line, and thus is not repeated herein.

With reference to FIG. 1 and FIG. 2, when being operated in an initiation period (also called as a reset period) Pinit of the $Y-1^{th}$ display line, a reset signal INIT is pulled down. At this time, the transistors $M_1$, $M_2$, $M_3$, $M_4$, and $M_6$ are turned off, and the transistors $M_5$ and $M_7$ are turned on. Therefore, the reference voltage VREF may reset the emission element EE and the storage capacitor $C_{ST}$ to prepare for the next charging of the storage capacitor $C_{ST}$. When being operated in a data scanning period Pscan of the $Y^{th}$ display line, the scan signal SCAN is pulled down. At this time, the transistors $M_2$, $M_5$, $M_6$, and $M_7$ are turned off, and the transistors $M_1$, $M_3$, and $M_4$ are turned on. Therefore, an output buffer (not shown) of the DDIC begins to charge the storage capacitor $C_{ST}$ to a target level (the data voltage DATA corresponding to the display data) through the data line together with the transistor $M_3$ connected in the form of a diode. When being operated in an emission period Pemi of the $Y+1^{th}$ display line, the emission signal EMI is pulled down. At this time, the transistors $M_1$, $M_4$, $M_5$, and $M_7$ are closed to be turned off, and the transistors $M_2$, $M_3$, and $M_6$ are turned on, such that the emission element EE performs light emitting and displaying. A data voltage (i.e., a gate voltage Vg of the transistor $M_3$) of the storage capacitor $C_{ST}$ may determine a source gate voltage VSG of the transistor $M_3$. Hence, the gate voltage Vg may control a current flowing through the transistor $M_3$ and further controls luminance of the emission element EE.

In the data scanning period Pscan, the output buffer (not shown) of the DDIC may write the data voltage DATA corresponding to the display data to the storage capacitor $C_{ST}$. Nevertheless, as affected by a diode property of the transistor $M_3$ connected in the form of a diode, the gate voltage Vg of the transistor $M_3$ may experience voltage overcharging in the data scanning period Pscan. DATA1 shown in FIG. 2 represents a curve of the data voltage DATA without experiencing an overcharging phenomenon OS, and DATA2 shown in FIG. 2 represents a curve of the data voltage DATA experiencing the overcharging phenomenon OS. If the charge-sharing operation is unconditionally performed on the data line of the OLED panel, the overcharging phenomenon OS may occur frequently. The data voltage DATA experiencing the overcharging phenomenon OS may be written into the storage capacitor $C_{ST}$. Vg1 shown in FIG. 2 represents a curve of the gate voltage Vg without experiencing the overcharging phenomenon OS, Vg2 shown in FIG. 2 represents an expected curve of the gate voltage Vg experiencing the overcharging phenomenon OS, and Vg3 shown in FIG. 2 represents an actual curve of the gate voltage Vg experiencing the overcharging phenomenon OS. After the overcharge phenomenon OS occurs, the gate voltage Vg of the transistor $M_3$ is expected to follow the curve DATA2 of the data voltage DATA to the target level (as shown by the expected curve Vg2). In the data scanning period Pscan, the transistor $M_3$ exhibits the diode property, such that the gate voltage Vg cannot follow the curve DATA2 of the data voltage DATA to the target standard position (as shown by the actual curve Vg3). When voltage overcharging occurs in the gate voltage Vg of the transistor $M_3$, the voltage of the storage capacitor $C_{ST}$ may not follow an output voltage (the curve DATA2 of the data voltage DATA) of the output buffer (not shown) to the target level, leading to abnormal display of the OLED panel.

In the following embodiments, an equalization operation of a light-emitting diode (LED) display panel is described. According to design needs, the LED display panel may be an organic light-emitting display (OLED) panel or other types of display panels. Based on a relationship between a previous line and a current line and a final value of a data line after data line EQ is completed, a driver device may determine whether to perform an equalization operation on an adjacent data line. The equalization operation refers to providing a short-circuit path between two data lines of the display panel, so that voltages of the two data lines temporarily become consistent. Generally, the time of the equalization operation is extremely short. After the equalization operation ends, the short-circuit path is cut off, and normal operation may thus be prevented from being affected. When a predetermined condition is met, the driver device may perform the equalization operation on the adjacent data line. In contrast, when the predetermined condition is not met, the driver device may not perform the equalization operation. As the equalization operation may be selectively performed, the driver device may not only reduce a voltage swing caused by charging and discharging operations performed on the data line but may also prevent an overcharging phenomenon caused by the equalization operation from occurring.

Figure 3:
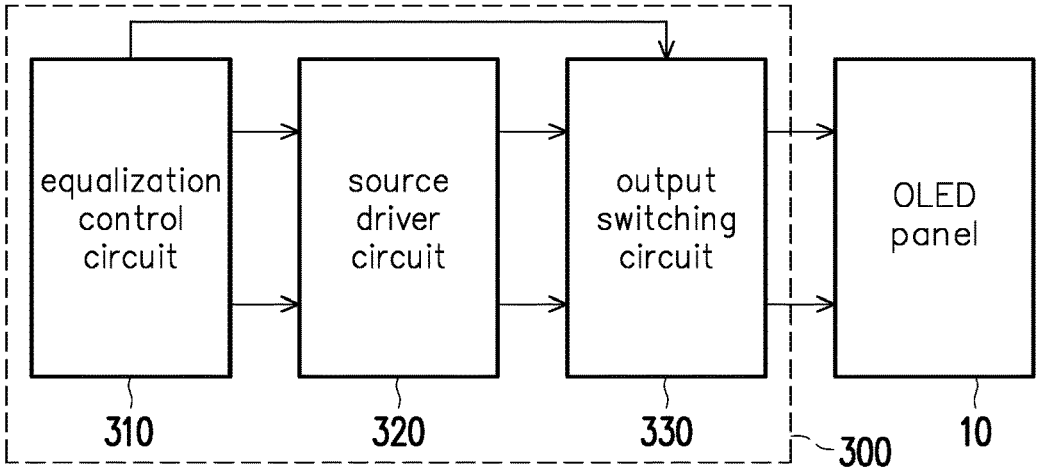
FIG. 3 is a schematic diagram of circuit blocks of a driver device according to an embodiment of the disclosure.

FIG. 3 is a schematic diagram of circuit blocks of a driver device 300 according to an embodiment of the disclosure. The driver device 300 shown in FIG. 3 is adapted to drive an LED display panel, such as an OLED panel 10 or other types of display panels. The driver device 300 includes an equalization control circuit 310, a source driver circuit 320, and an output switching circuit 330. Based on control performed by a timing controller (not shown), the equalization control circuit 310 may provide sub-pixel data of a first data line and sub-pixel data of the second data line to the source driver circuit 320. The source driver circuit 320 may convert the sub-pixel data to a data voltage.

A first input end and a second input end of the output switching circuit 330 are respectively coupled to a first output end and a second output end of the source driver circuit 320. A first output end and a second output end of the output switching circuit 330 are adapted to be coupled to a first data line and a second data line of the OLED panel 10. The source driver circuit 320 may transmit the data voltage to the first data line and the second data line of the OLED panel 10 through the output switching circuit 330. In addition, the output switching circuit 330 may selectively perform the equalization operation on the first data line and the second data line of the OLED panel 10. The OLED panel 10 includes a plurality of display sub-pixels, and each of these display sub-pixels includes a storage capacitor (e.g., the storage capacitor $C_{ST}$ shown in FIG. 1) for storing charges (data voltage) of the sub-pixel data.

Figure 4:
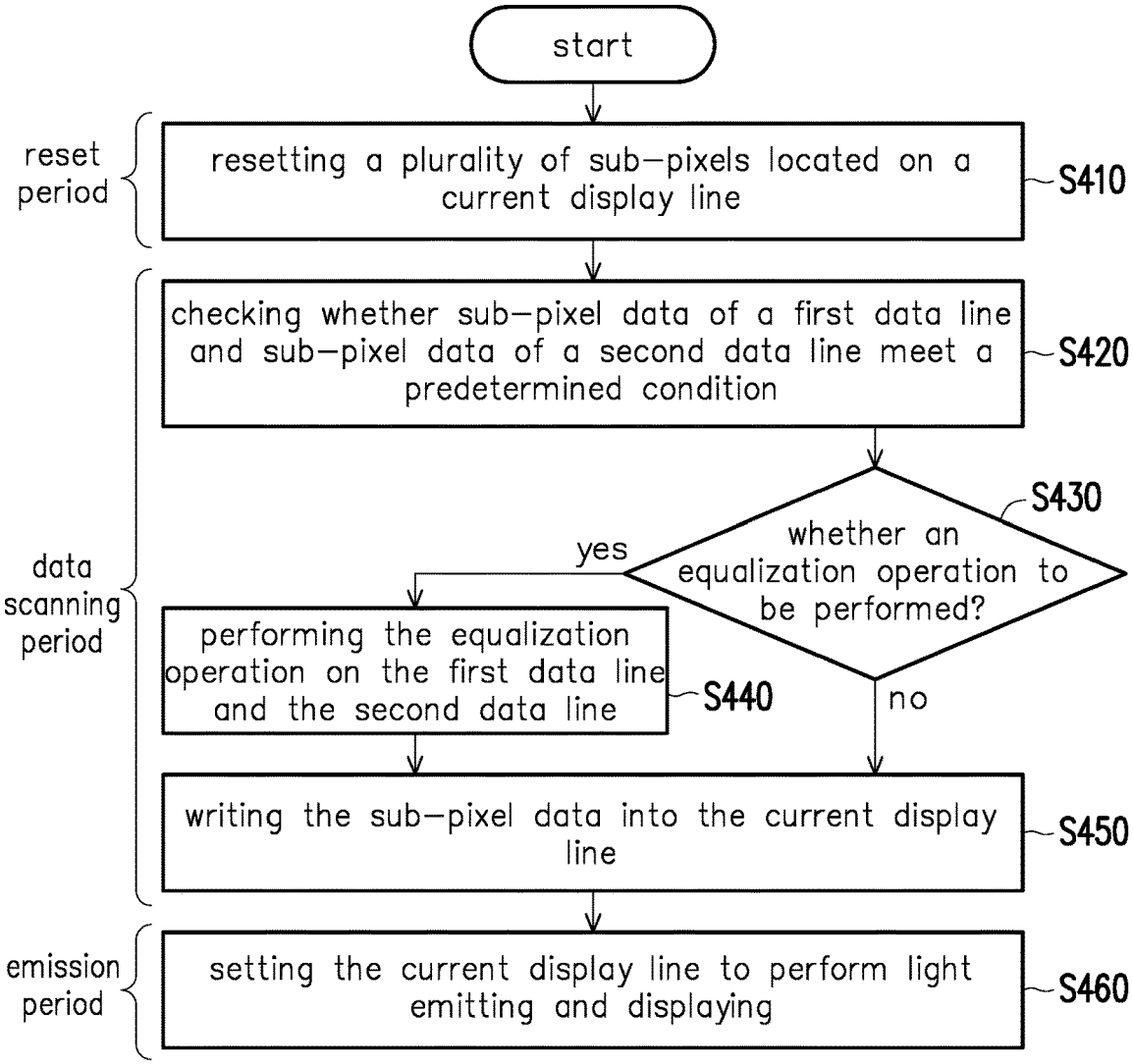
FIG. 4 is a schematic flow chart of an operation method of the driver device according to an embodiment of the disclosure.

FIG. 4 is a schematic flow chart of an operation method of the driver device 300 according to an embodiment of the disclosure. In the embodiment shown in FIG. 4, the driving operation performed by the driver device 300 on the OLED panel 10 may at least be divided into a reset period, a data scanning period, and an emission period. With reference to FIG. 3 and FIG. 4, in the reset period, a plurality of sub-pixels of the OLED panel 10 located on a current display line of the OLED panel 10 are reset (step S410). The sub-pixels include an emission element (e.g., an organic light-emitting diode or other light-emitting diodes). Implementation of the sub-pixels is not limited by the present embodiment. According to design needs, in some embodiments, reference of the sub-pixels of the OLED panel 10 may be made by referring to the description related to the sub-pixel circuit provided in FIG. 1 and FIG. 2. In other embodiments, the sub-pixels of the OLED panel 10 may be other sub-pixel circuits. The data scanning period begins after the reset period.

The equalization control circuit 310 may check whether the sub-pixel data of the first data line and the sub-pixel data of the second data line meet the predetermined condition in the data scanning period (step S420). The predetermined condition may prevent the storage capacitors (e.g., the storage capacitor $C_{ST}$ shown in FIG. 1) in the sub-pixels of the OLED panel 10 from being excessive charged. Note that according to design needs, in some other embodiments, the equalization control circuit 310 may perform step S420 after the reset period and before the data scanning period. In still other embodiments, the equalization control circuit 310 may perform step S420 in the reset period.

After the reset period, the equalization control circuit 310 may determine whether to control the output switching circuit to perform the equalization operation on the first data line and the second data line in the data scanning period according to the checking result (step S430). When the sub-pixel data of the first data line and the sub-pixel data of the second data line does not meet the predetermined condition (the determination result in step S430 is "no"), the driver device 300 performs step S450. When the sub-pixel data of the first data line and the sub-pixel data of the second data line meet the predetermined condition (the determination result in step S430 is "yes"), the driver device 300 performs step S440.

In step S440, based on control performed by the equalization control circuit 310, the output switching circuit 330 performs the equalization operation on the first data line and the second data line of the OLED panel 10. For instance, the output switching circuit 330 may set the first data line to be electrically connected to the second data line in step S440 and set the first data line not to be electrically connected to the second data line after step S440 ends. After step S440 ends, the driver device 300 performs step S450.

In step S450, the source driver circuit 320 may transmit the sub-pixel data (the data voltage) to the first data line and the second data line of the OLED panel 10 through the output switching circuit 330 to write the sub-pixel data into the sub-pixels on the current display line of the OLED panel 10. The emission period begins after the data scanning period. In the emission period, the driver device 300 sets the sub-pixels on the current display line of the OLED panel 10 to perform light emitting and displaying (that is, lighting up emission elements in the sub-pixels, step S460).

Based on the above, based on the checking result of "whether the sub-pixel data of the first data line and the sub-pixel data of the second data line of the OLED panel 10 meet the predetermined condition", the driver device 300 provided by this embodiment may determine whether to perform the equalization operation on the first data line and the second data line. For instance, when the predetermined condition is met, the output switching circuit 330 may perform the equalization operation to reduce the voltage swing caused by the charging and discharging operations performed on the data lines. When the predetermined condition is not met, the output switching circuit 330 does not perform the equalization operation to prevent the overcharging phenomenon from occurring. Hence, the driver device 300 may prevent the overcharging phenomenon caused by the equalization operation from occurring. In particular, regarding a sub-pixel (e.g., the sub-pixel circuit shown in FIG. 1) of a transistor connected in the form of a diode, the overcharging phenomenon is less allowed to occur in this type of sub-pixel.

The predetermined condition may be defined according to design needs. For instance, in some embodiments, the sub-pixel data of the first data line to be checked includes previous sub-pixel data and current sub-pixel data, and the sub-pixel data of the second data line to be checked includes previous sub-pixel data and current sub-pixel data. The predetermined condition may include a relationship among the four. The equalization control circuit 310 may check the previous sub-pixel data of the first data line, the current sub-pixel data of the first data line, the previous sub-pixel data of the second data line, and the current sub-pixel data of the second data line in step S420 to determine whether to control the output switching circuit 330 to perform the equalization operation on the first data line and the second data line. The output switching circuit 330 may perform the equalization operation on the first data line and the second data line in the data scanning period corresponding to the current display line of the OLED panel 10.

In some embodiments, the equalization control circuit 310 may check a changing direction of the sub-pixel data of the first data line and a changing direction of the sub-pixel data of the second data line (the predetermined condition) in step S420. For instance, in some embodiments, the predetermined condition includes a condition one and a condition two. The condition one is whether "a direction from a previous voltage level corresponding to the previous sub-pixel data of the first data line towards an equalized level of the first data line and the second data line" is consistent with "a direction from the previous voltage level corresponding to the previous sub-pixel data of the first data line towards a current voltage level corresponding to the current sub-pixel data of the first data line". The condition two is whether "a direction from a previous voltage level corresponding to the previous sub-pixel data of the second data line towards the equalized level of the first data line and the second data line" is consistent with "a direction from the previous voltage level corresponding to the previous sub-pixel data of the second data line towards a current voltage level corresponding to the current sub-pixel data of the second data line".

When the previous sub-pixel data of the first data line is greater than the previous sub-pixel data of the second data line, when the current sub-pixel data of the first data line is less than a mean of the previous sub-pixel data of the first data line and the previous sub-pixel data of the second data line, and when the current sub-pixel data of the second data line is greater than the mean, the equalization control circuit 310 may control the output switching circuit 330 to perform the equalization operation. When the previous sub-pixel data of the first data line is less than the previous sub-pixel data of the second data line, when the current sub-pixel data of the first data line is greater than the mean, and when the current sub-pixel data of the second data line is less than the mean, the equalization control circuit 310 may control the output switching circuit 330 to perform the equalization operation.

Figure 5:
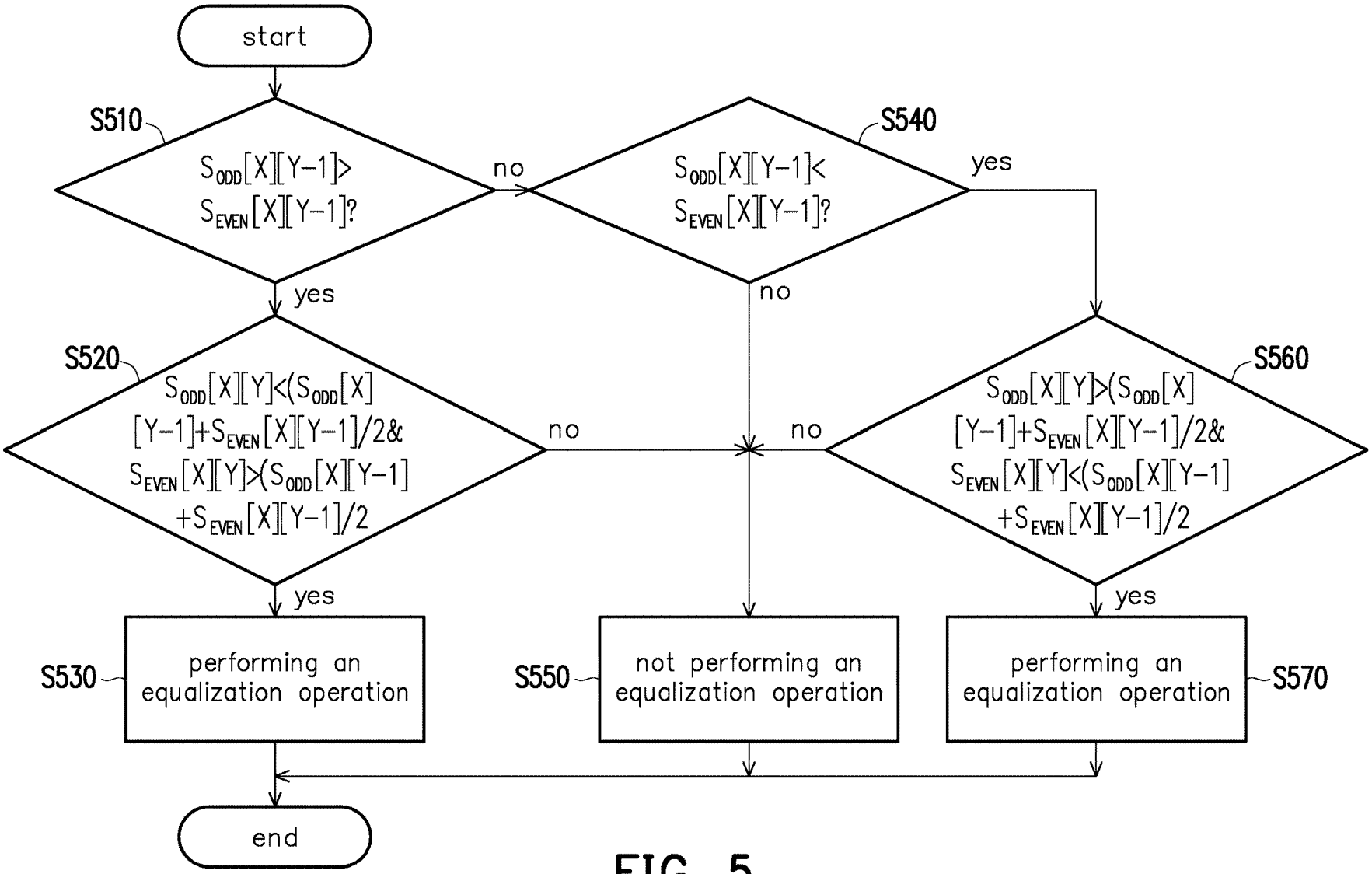
FIG. 5 is a schematic flow chart of an operation method of the driver device according to another embodiment of the disclosure.

FIG. 5 is a schematic flow chart of an operation method of the driver device 300 according to another embodiment of the disclosure. In the embodiment shown in FIG. 5, the equalization control circuit 310 may compare previous sub-pixel data $S_{ODD}[X][Y-1]$ of the first data line and previous sub-pixel data $S_{EVEN}[X][Y-1]$ of the second data line (step S510). When the previous sub-pixel data $S_{OD}[X][Y-1]$ is greater than the previous sub-pixel data $S_{EVEN}[X][Y-1]$ (the determination result in step S510 is "yes"), the driver device 300 performs step S520. In step S520, the equalization control circuit 310 may compare between $S_{ODD}[X][Y]$ and $(S_{ODD}[X][Y-1]+S_{EVEN}[X][Y-1])/2$ and compares between $S_{EVEN}[X][Y]$ and $(S_{ODD}[X][Y-1]+S_{EVEN}[X][Y-1])/2$. Herein, $S_{ODD}[X][Y]$ is the current sub-pixel data of the first data line, $S_{EVEN}[X][Y]$ is the current sub-pixel data of the second data line, and $(S_{ODD}[X][Y-1]+S_{EVEN}[X][Y-1])/2$ is a mean of the previous sub-pixel data $S_{ODD}[X][Y-1]$ and the previous sub-pixel data $S_{EVEN}[X][Y-1]$.

When the current sub-pixel data of the first data line is less than the mean (i.e., $S_{ODD}[X][Y]<(S_{ODD}[X][Y-1]+S_{EVEN}[X][Y-1])/2$) and when the current sub-pixel data of the second data line is greater than the mean (i.e., $S_{EVEN}[X][Y]>(S_{ODD}[X][Y-1]+S_{EVEN}[X][Y-1])/2$), the determination result in step S520 is "yes", so that the driver device 300 performs step S530. In step S530, the equalization control circuit 310 may control the output switching circuit 330 to perform the equalization operation on the first data line and the second data line of the OLED panel 10. The equalization operation may set voltages of the first data line and the second data line to be equal to a voltage level corresponding to the mean $(S_{ODD}[X][Y-1]+S_{EVEN}[X][Y-1])/2$. When the determination result in step S520 is "no", the driver device 300 performs step S550. In step S550, the equalization control circuit 310 may control the output switching circuit 330 not to perform the equalization operation on the first data line and the second data line of the OLED panel 10.

When the previous sub-pixel data $S_{ODD}[X][Y-1]$ is not greater than the previous sub-pixel data $S_{EVEN}[X][Y-1]$ (the determination result in step S510 is "no"), the driver device 300 performs step S540. In step S540, the equalization control circuit 310 may determine whether the previous sub-pixel data $S_{ODD}[X][Y-1]$ of the first data line is less than the previous sub-pixel data $S_{EVEN}[X][Y-1]$ of the second data line. When the previous sub-pixel data $S_{ODD}[X][Y-1]$ is not less than the previous sub-pixel data $S_{EVEN}[X][Y-1]$ (the determination result in step S540 is "no"), the driver device 300 performs step S550. In step S550, the equalization control circuit 310 may control the output switching circuit 330 not to perform the equalization operation on the first data line and the second data line of the OLED panel 10.

When the previous sub-pixel data $S_{ODD}[X][Y-1]$ is less than the previous sub-pixel data $S_{EVEN}[X][Y-1]$ (the determination result in step S540 is "yes"), the driver device 300 performs step S560. In step S560, the equalization control circuit 310 may compare between $S_{ODD}[X][Y]$ and $(S_{ODD}[X][Y-1]+S_{EVEN}[X][Y-1])/2$ and compares between $S_{EVEN}[X][Y]$ and $(S_{ODD}[X][Y-1]+S_{EVEN}[X][Y-1])/2$. When the current sub-pixel data of the first data line is greater than the mean (i.e., $S_{ODD}[X][Y]>(S_{ODD}[X][Y-1]+S_{EVEN}[X][Y-1])/2$) and when the current sub-pixel data of the second data line is less than the mean (i.e., $S_{EVEN}[X][Y]<(S_{ODD}[X][Y-1]+S_{EVEN}[X][Y-1])/2$, the determination result in step S560 is "yes", so that the driver device 300 performs step S570. In step S570, the equalization control circuit 310 may control the output switching circuit 330 to perform the equalization operation on the first data line and the second data line of the OLED panel 10. When the determination result in step S560 is "no", the driver device 300 performs step S550. In step S550, the equalization control circuit 310 may control the output switching circuit 330 not to perform the equalization operation on the first data line and the second data line of the OLED panel 10.

Determination conditions of the equalization operation include determination of whether voltages of two adjacent data lines are different and consideration of whether an overcharging problem occurs in the data lines after the equalization operation ends. The determination of the difference between two adjacent data lines is to ensure that the equalization operation provides a power saving effect. Determining whether a voltage changing direction of two adjacent data lines in the equalization operation is consistent with a target voltage direction of the data line may prevent the problem of data line overcharging from occurring. Hence, the driver device 300 may ensure that a visual effect of the OLED panel 10 is not affected after the equalization operation is completed.

Figure 6:
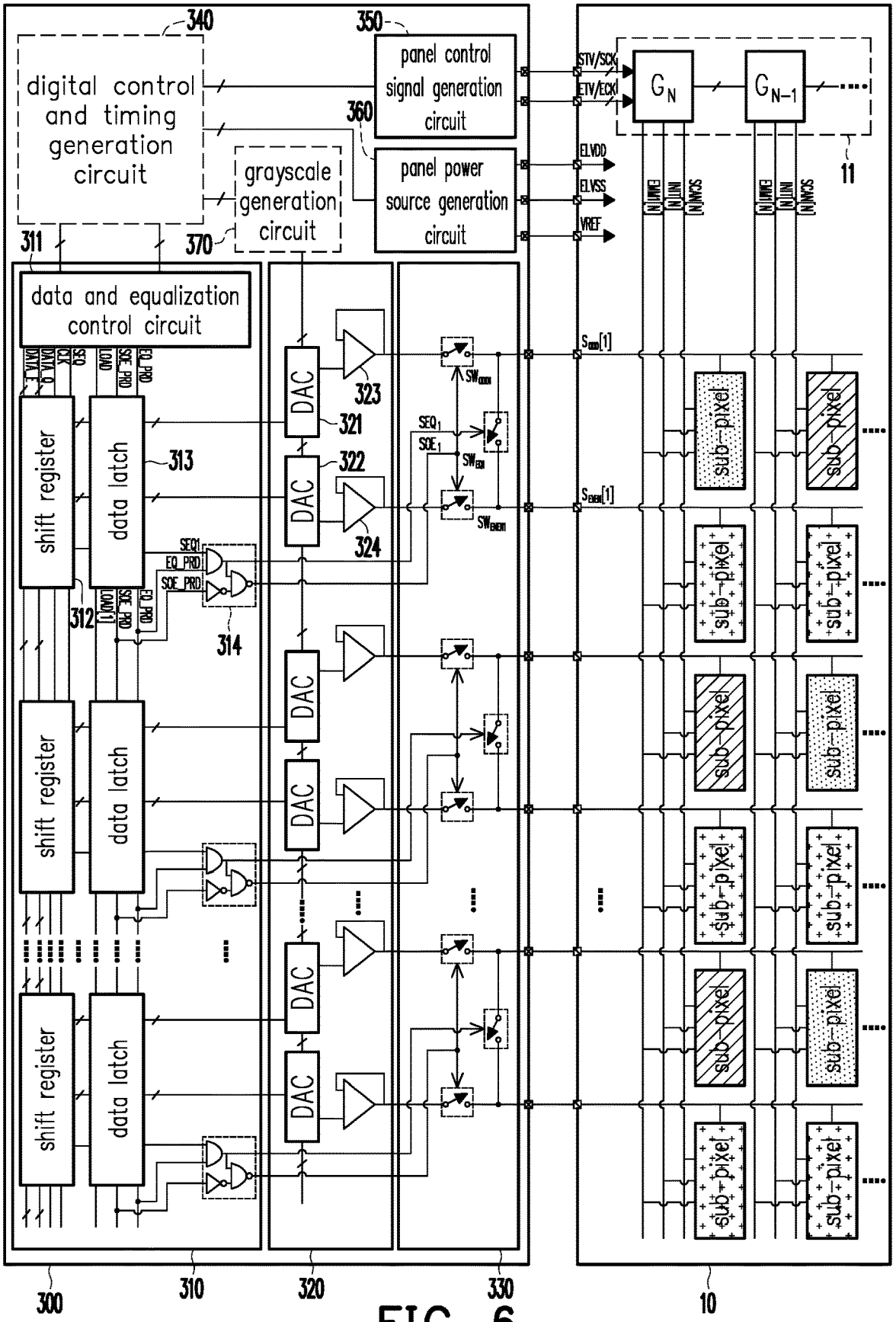
FIG. 6 is a schematic diagram describing circuit blocks describing an equalization control circuit, a source driver circuit, and an output switching circuit shown in FIG. 3 according to an embodiment of the disclosure.

FIG. 6 is a schematic diagram describing circuit blocks describing the equalization control circuit 310, the source driver circuit 320, and the output switching circuit 330 shown in FIG. 3 according to an embodiment of the disclosure. In the embodiment shown in FIG. 6, the driver device 300 further includes a digital control and timing generation circuit 340, a panel control signal generation circuit 350, a panel power source generation circuit 360, and a grayscale generation circuit 370. The digital control and timing generation circuit 340 may also be called as a timing controller. The digital control and timing generation circuit 340 may control the equalization control circuit 310, the panel control signal generation circuit 350, the panel power source generation circuit 360, and the grayscale generation circuit 370. Besides, the digital control and timing generation circuit 340 may further provide timing information (e.g., a clock signal) to the equalization control circuit 310 and the panel control signal generation circuit 350 to provide the sub-pixel data to the equalization control circuit 310. Based on control performed by the digital control and timing generation circuit 340, the grayscale generation circuit 370 may provide a grayscale voltage to the source driver circuit 320.

Based on the timing information provided by the digital control and timing generation circuit 340, the panel control signal generation circuit 350 may generate a scan start pulse STV, a scan clock signal SCK, an emission start pulse ETV, and an emission clock signal ECK to a gate driver 11. The gate driver 11 includes a plurality of driving channels, such as driving channels GN and GN-1 shown in FIG. 6. The gate driver 11 may generate a reset signal INIT (e.g., a reset signal INIT[N] of a Nth reset line and a reset signal INIT[N−1] of a N−1th reset line), a scan signal SCAN (e.g., a scan line SCAN[N] of a Nth display line and a scan signal SCAN[N−1] of a N−1th display line), and an emission signal EMI (e.g., an emission signal EMI[N] of a Nth emission line and an emission signal EMI[N−1] of a N−1th emission line) to the sub-pixels of the OLED panel 10. According to design needs, in some embodiments, description of the sub-pixels of the OLED panel 10 shown in FIG. 6 may be deduced with reference to the description related to the sub-pixel circuit shown in FIG. 1 and FIG. 2 and thus is not repeated herein. In addition, based on control performed by the digital control and timing generation circuit 340, the panel power source generation circuit 360 may provide an anode voltage ELVDD, a cathode voltage ELVSS, and the reference voltage VREF to the OLED panel 10.

Figure 7:
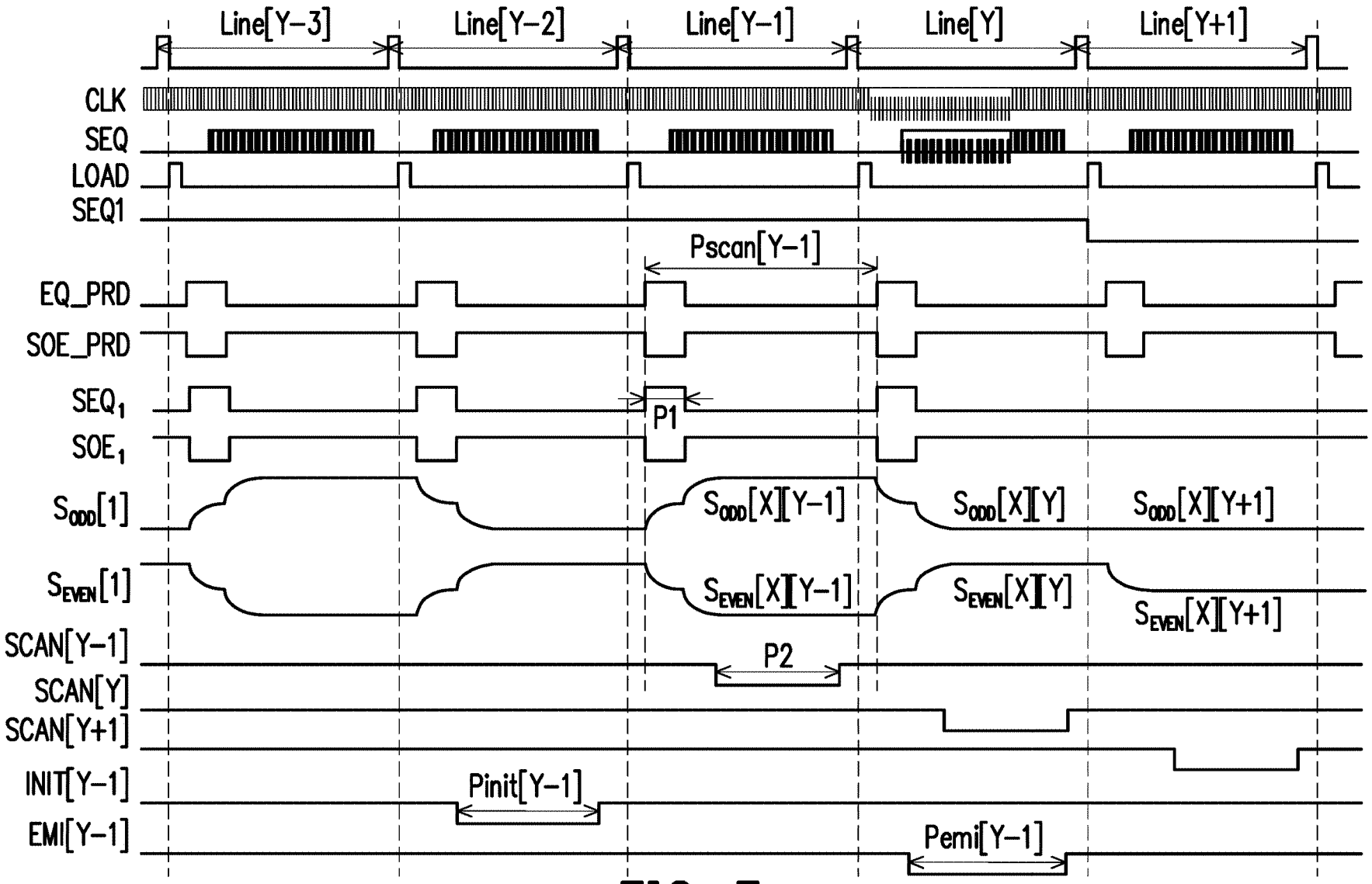
FIG. 7 is a schematic diagram describing waveforms of signals shown in FIG. 6 according to an embodiment of the disclosure.

FIG. 7 is a schematic diagram describing waveforms of the signals shown in FIG. 6 according to an embodiment of the disclosure. With reference to FIG. 6 and FIG. 7, the horizontal axis shown in FIG. 7 represents time. As shown in FIG. 7, Line[Y−3], Line[Y−2], Line[Y−1], Line[Y], and Line[Y+1] respectively represent horizontal periods of a $Y-3^{th}$ display line, a $Y-2^{th}$ display line, a $Y-1^{th}$ display line, a $Y^{th}$ display line, and a $Y+1^{th}$ display line. SCAN[Y−1], SCAN[Y], and SCAN[Y+1] shown in FIG. 7 respectively represent the scan signals SCAN of the $Y-1^{th}$, $Y^{th}$, and $Y+1^{th}$ display lines. INIT[Y−1] shown in FIG. 7 represents a reset signal INIT of the $Y-1^{th}$ display line. EMI[Y−1] shown in FIG. 7 represents an emission signal EMI of the $Y-1^{th}$ display line. Pinit[Y−1] shown in FIG. 7 represents a reset period Pinit of the $Y-1^{th}$ display line. Pscan[Y−1] shown in FIG. 7 represents a data scanning period Pscan of the $Y-1^{th}$ display line. Pemi[Y−1] shown in FIG. 7 represents an emission period Pemi of the $Y-1^{th}$ display line. $S_{ODD}[X][Y-1]$, $S_{ODD}[X][Y]$, and $S_{ODD}[X][Y+1]$ shown in FIG. 7 respectively represent previous sub-pixel data, current sub-pixel data, and next sub-pixel data of a first data line $S_{ODD}[1]$. $S_{EVEN}[X][Y-1]$, $S_{EVEN}[X][Y]$, and $S_{EVEN}[X][Y+1]$ shown in FIG. 7 respectively represent previous sub-pixel data, current sub-pixel data, and next sub-pixel data of a second data line $S_{EVEN}[1]$.

The equalization control circuit 310 shown in FIG. 6 includes a data and equalization control circuit 311, a shift register 312, a data latch 313, and a logic circuit 314. The data and equalization control circuit 311 is coupled to the digital control and timing generation circuit 340 to receive a sub-pixel data stream. Based on the sub-pixel data stream, the data and equalization control circuit 311 may check whether sub-pixel data of the first data line $S_{ODD}[1]$ and sub-pixel data of the second data line $S_{EVEN}[1]$ meet the predetermined condition and sets an equalization control signal SEQ according to the checking result. For instance, the data and equalization control circuit 311 may check the previous sub-pixel data and the current sub-pixel data of the first data line $S_{ODD}[1]$, and the data and equalization control circuit 311 may check the previous sub-pixel data and the current sub-pixel data of the second data line $S_{EVEN}[1]$ and sets the equalization control signal SEQ according to the checking result The shift register 312 is coupled to the data and equalization control circuit 311 to receive the equalization control signal SEQ, the clock signal CLK, sub-pixel data DATA_O, and sub-pixel data DATA_E. The data latch 313 is coupled to the shift register 312 to receive the equalization control signal SEQ, the sub-pixel data DATA_O, and the sub-pixel data DATA_E. The data latch 313 is further coupled to the data and equalization control circuit 311 to receive a latch signal LOAD, an output enabling clock SOE_PRD, and an equalization clock EQ_PRD. The logic circuit 314 is coupled to the data latch 313 to receive an equalization control signal SEQ1. The logic circuit 314 is further coupled to the data and equalization control circuit 311 through the data latch 313 to receive the output enabling clock SOE_PRD and the equalization clock EQ_PRD.

The source driver circuit 320 includes a digital to analog converter (DAC) 321, a DAC 322, an output buffer 323, and an output buffer 324. According to design needs, the output buffer 323 and the output buffer 324 may be operational (OP) amplifiers or other gain circuits. An input end of the DAC 321 is coupled to a first output end of the data latch 313. An input end of the DAC 322 is coupled to a second output end of the data latch 313. An input end of the output buffer 323 is coupled to an output end of the DAC 321. An output end of the output buffer 323 is coupled to the output switching circuit 330. An input end of the output buffer 324 is coupled to an output end of the DAC 322. An output end of the output buffer 324 is coupled to the output switching circuit 330.

The logic circuit 314 generates switch signals $SEQ_1$ and $SOE_1$ according to the equalization control signal SEQ1, the output enabling clock SOE_PRD, and the equalization clock EQ_PRD to control the output switching circuit 330. The output switching circuit 330 shown in FIG. 6 includes an output switch $SW_{ODD1}$, an output switch $SW_{EVEN1}$, and an equalization switch $SW_{EQ1}$. A first end of the output switch $SW_{ODD1}$ is coupled to the first output end of the source driver circuit 320. A second end of the output switch $SW_{ODD1}$ is adapted to be coupled to the first data line $S_{ODD}[1]$ of the OLED panel 10. A first end of the output switch $SW_{EVEN1}$ is coupled to the second output end of the source driver circuit 320. A second end of the output switch $SW_{EVEN1}$ is adapted to be coupled to the second data line $S_{EVEN}[1]$ of the OLED panel 10. A first end and a second end of the equalization switch $SW_{EQ1}$ are respectively coupled to the second end of the output switch $SW_{ODD1}$ and the second end of the output switch $SW_{EVEN1}$.

When the equalization control circuit 310 determines to control the output switching circuit 330 to perform the equalization operation in the data scanning period Pscan[Y−1], the equalization control circuit 310 determines to control the output switch $SW_{ODD1}$ and the output switch $SW_{EVEN1}$ to be turned off and the equalization switch $SW_{EQ1}$ to be turned on in a first sub-period P1 of the data scanning period Pscan[Y−1]. Moreover, the equalization control circuit 310 determines to control the output switch $SW_{ODD1}$ and the output switch $SW_{EVEN1}$ to be turned on and the equalization switch $SW_{EQ1}$ to be turned off in a second sub-period P2 of the data scanning period Pscan[Y−1] after the first sub-period P1. For instance, when the equalization control signal SEQ1 is at a high logic level (representing that the equalization operation is determined to be performed), the logic circuit 314 turns off the output switch $SW_{ODD1}$ and the output switch $SW_{EVEN1}$ and turns on the equalization switch $SW_{EQ1}$ in the first sub-period P1 of the data scanning period Pscan[Y−1] and turns on the output switch $SW_{ODD1}$ and the output switch $SW_{EVEN1}$ and turns off the equalization switch $SW_{EQ1}$ in the second sub-period P2 of the data scanning period Pscan[Y−1].

When the equalization control circuit 310 determines not to control the output switching circuit 330 to perform the equalization operation in the data scanning period Pscan[Y−1], the equalization control circuit 310 continuously turns off the equalization switch $SW_{EQ1}$ in the data scanning period Pscan[Y−1]. For instance, when the equalization control signal SEQ1 is at a low logic level (representing that the equalization operation is determined not to be performed), the logic circuit 314 may continuously turns on the output switch $SW_{ODD1}$ and the output switch $SW_{EVEN1}$ and continuously turns off the equalization switch $SW_{EQ1}$ in the data scanning period Pscan[Y−1].

Figure 8:
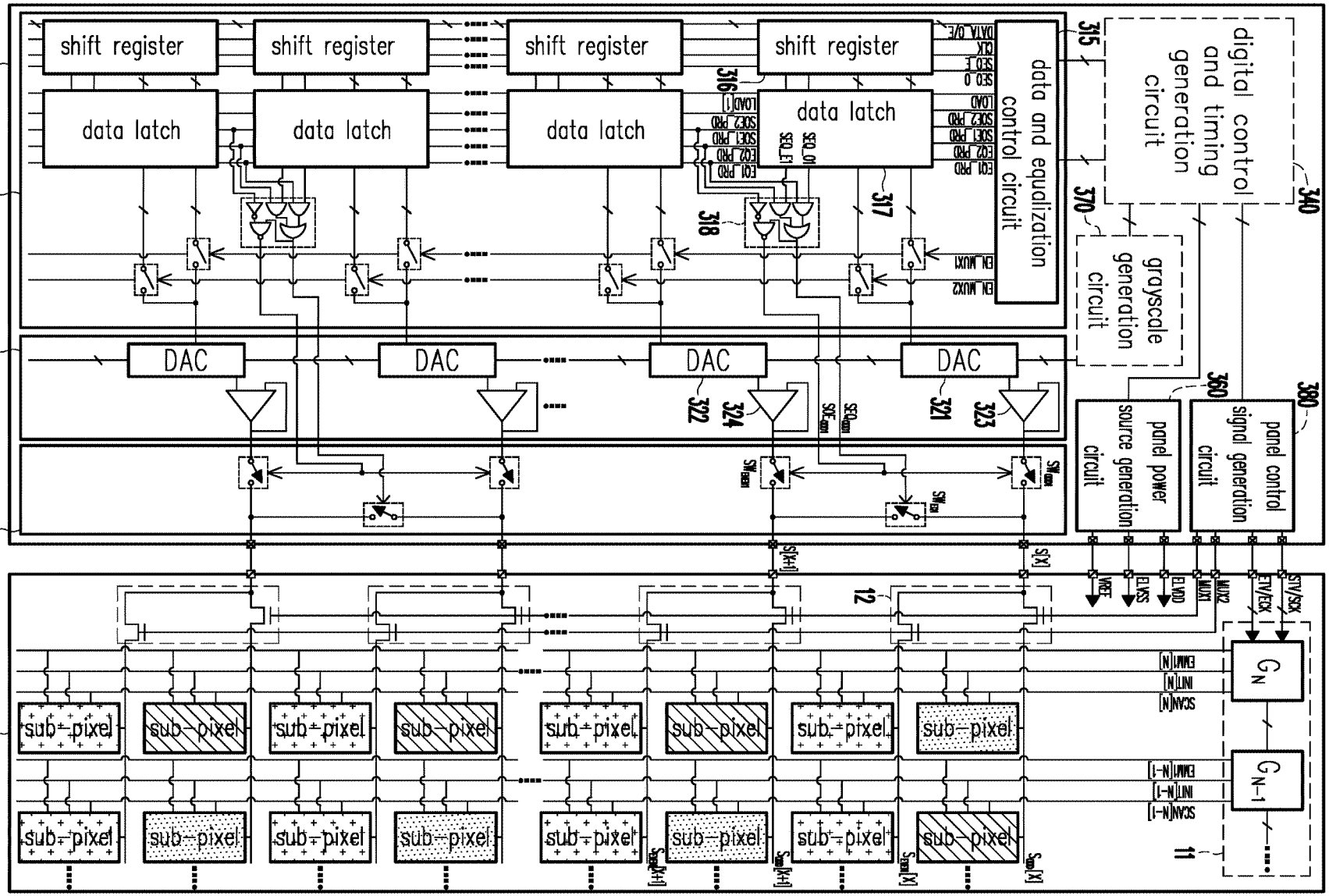
FIG. 8 is a schematic diagram of circuit blocks describing the equalization control circuit, the source driver circuit, and the output switching circuit shown in FIG. 3 according to another embodiment of the disclosure.

FIG. 8 is a schematic diagram of circuit blocks describing the equalization control circuit 310, the source driver circuit 320, and the output switching circuit 330 shown in FIG. 3 according to another embodiment of the disclosure. In the embodiment shown in FIG. 8, the driver device 300 further includes a digital control and timing generation circuit 340, a panel control signal generation circuit 380, a panel power source generation circuit 360, and a grayscale generation circuit 370. Description of the driver device 300, the equalization control circuit 310, the source driver circuit 320, the output switching circuit 330, the digital control and timing generation circuit 340, the panel control signal generation circuit 380, the panel power source generation circuit 360, and the grayscale generation circuit 370 shown in FIG. 8 may be deduced with reference to the description related to the driver device 300, the equalization control circuit 310, the source driver circuit 320, the output switching circuit 330, the digital control and timing generation circuit 340, the panel control signal generation circuit 350, the panel power source generation circuit 360, and the grayscale generation circuit 370 shown in FIG. 6 and thus is not repeated herein.

In the embodiment shown in FIG. 8, based on the timing information provided by the digital control and timing generation circuit 340, the panel control signal generation circuit 380 may generate a scan start pulse STV, a scan clock signal SCK, an emission start pulse ETV, and an emission clock signal ECK to a gate driver 11 and generates a switching signal MUX1 and a switching signal MUX2 to a switching circuit 12. Description of the OLED panel 10 and the gate driver 11 shown in FIG. 8 may be deduced with reference to the description related to the OLED panel 10 and the gate driver 11 shown in FIG. 6 and thus is not repeated herein.

Figure 9:
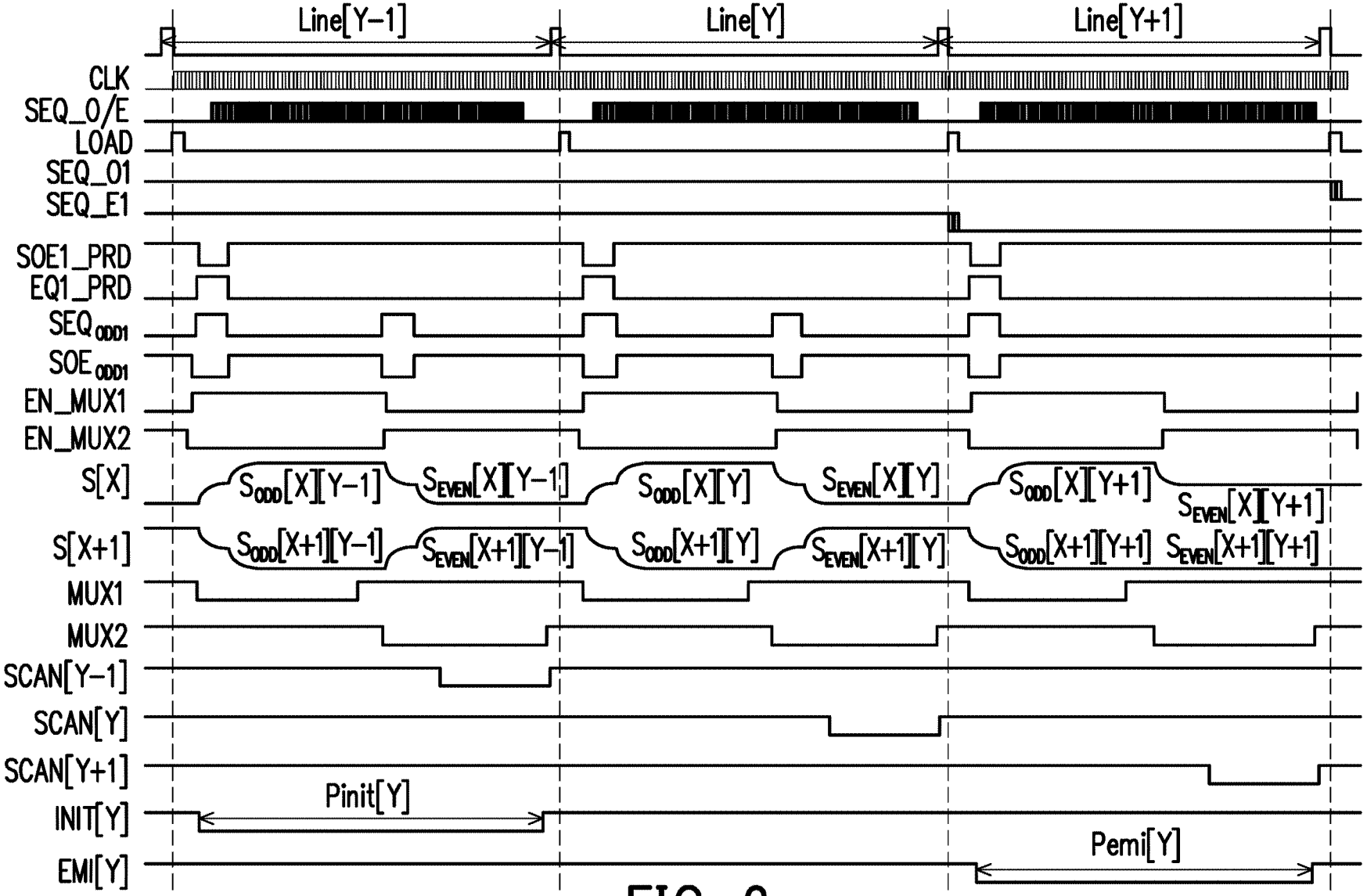
FIG. 9 is a schematic diagram describing waveforms of the signals shown in FIG. 8 according to an embodiment of the disclosure.

FIG. 9 is a schematic diagram describing waveforms of the signals shown in FIG. 8 according to an embodiment of the disclosure. With reference to FIG. 8 and FIG. 9, the horizontal axis shown in FIG. 9 represents time. As shown in FIG. 9, Line[Y−1], Line[Y], and Line[Y+1] respectively represent horizontal periods of a $Y-1^{th}$ display line, an $Y^{th}$ display line, and a $Y+1^{th}$ display line. SCAN[Y−1], SCAN[Y], and SCAN[Y+1] shown in FIG. 9 respectively represent the scan signals SCAN of the $Y-1^{th}$, $Y^{th}$, and $Y+1^{th}$ display lines. INIT[Y] shown in FIG. 9 represents a reset signal INIT of the $Y^{th}$ display line. EMI[Y] shown in FIG. 9 represents an emission signal EMI of the $Y^{th}$ display line. Pinit[Y] shown in FIG. 9 represents a reset period Pinit of the $Y^{th}$ display line. Pemi[Y−1] shown in FIG. 9 represents an emission period Pemi of the $Y-1^{th}$ display line. $S_{ODD}[X][Y-1]$, $S_{ODD}[X][Y]$, and $S_{ODD}[X][Y+1]$ shown in FIG. 9 respectively represent previous sub-pixel data, current sub-pixel data, and next sub-pixel data of a data line $S_{ODD}[X]$. $S_{EVEN}[X][Y-1]$, $S_{EVEN}[X][Y]$, and $S_{EVEN}[X][Y+1]$ shown in FIG. 9 respectively represent previous sub-pixel data, current sub-pixel data, and next sub-pixel data of a data line $S_{EVEN}[X]$. $S_{ODD}[X+1][Y-1]$, $S_{ODD}[X+1][Y]$, and $S_{ODD}[X+1][Y+1]$ shown in FIG. 9 respectively represent previous sub-pixel data, current sub-pixel data, and next sub-pixel data of a data line $S_{ODD}[X+1]$. $S_{EVEN}[X+1][Y-1]$, $S_{EVEN}[X+1][Y]$, and $S_{EVEN}[X+1][Y+1]$ shown in FIG. 9 respectively represent previous sub-pixel data, current sub-pixel data, and next sub-pixel data of a data line $S_{EVEN}[X+1]$.

The equalization control circuit 310 shown in FIG. 8 includes a data and equalization control circuit 315, a shift register 316, a data latch 317, and a logic circuit 318. The data and equalization control circuit 315 is coupled to the digital control and timing generation circuit 340 to receive a sub-pixel data stream. Based on the sub-pixel data stream, the data and equalization control circuit 315 may check whether sub-pixel data of the first data line S [X] and sub-pixel data of the second data line S[X+1] meet the predetermined condition and sets equalization control signals SEQ_O and SEQ_E according to the checking result. Description of the data and equalization control circuit 315, the shift register 316, the data latch 317, and the logic circuit 318 shown in FIG. 8 may be deduced with reference to the description of the data and equalization control circuit 315, the shift register 316, the data latch 317, and the logic circuit 318 shown in FIG. 6 and thus is not repeated herein.

The shift register 316 is coupled to the data and equalization control circuit 315 to receive the equalization control signal SEQ_O, the equalization control signal SEQ_E, the clock signal CLK, and the sub-pixel data DATA_O/E. The data latch 317 is coupled to the shift register 316 to receive the equalization control signal SEQ_O, the equalization control signal SEQ_E, and the sub-pixel data DATA_O/E. The data latch 317 is further coupled to the data and equalization control circuit 315 to receive the latch signal LOAD, the output enabling clock SOE1_PRD, the output enabling clock SOE2_PRD, the equalization clock EQ1_PRD, and the equalization clock EQ2_PRD.

The source driver circuit 320 includes a DAC 321, a DAC 322, an output buffer 323, and an output buffer 324. Description of the DAC 321, DAC 322, the output buffer 323, and the output buffer 324 shown in FIG. 8 may be deduced with reference to the related description of FIG. 6 and thus is not repeated herein.

The logic circuit 318 generates switch signals $SEQ_{ODD1}$ and $SOE_{ODD1}$ according to the equalization control signal SEQ_O1, the equalization control signal SEQ_E1, the output enabling clock SOE1_PRD, the output enabling clock SOE2_PRD, the equalization clock EQ1_PRD, and the equalization clock EQ2_PRD to control the output switching circuit 330. The output switching circuit 330 shown in FIG. 8 includes an output switch $SW_{ODD1}$, an output switch $SW_{EVEN1}$, and an equalization switch $SW_{EQ1}$. Description of the output switch $SW_{ODD1}$, the output switch $SW_{EVEN1}$, and the equalization switch $SW_{EQ1}$ shown in FIG. 8 may be deduced with reference to the related description of FIG. 6 and thus is not repeated herein.

Figure 10:
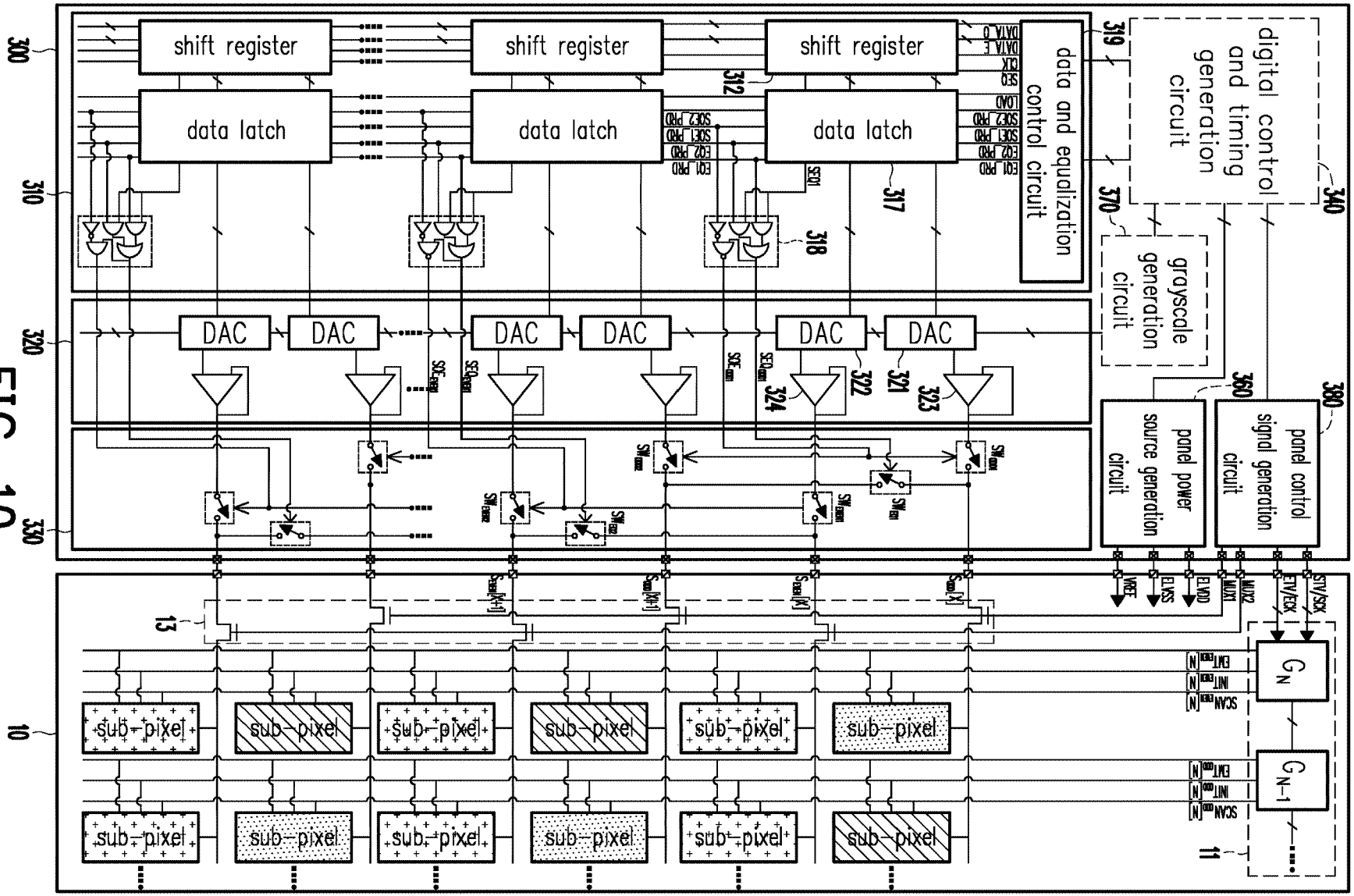
FIG. 10 is a schematic diagram of circuit blocks describing the equalization control circuit, the source driver circuit, and the output switching circuit shown in FIG. 3 according to still another embodiment of the disclosure.

FIG. 10 is a schematic diagram of circuit blocks describing the equalization control circuit 310, the source driver circuit 320, and the output switching circuit 330 shown in FIG. 3 according to still another embodiment of the disclosure. In the embodiment shown in FIG. 10, the driver device 300 further includes a digital control and timing generation circuit 340, a panel control signal generation circuit 380, a panel power source generation circuit 360, and a grayscale generation circuit 370. Description of the driver device 300, the equalization control circuit 310, the source driver circuit 320, the output switching circuit 330, the digital control and timing generation circuit 340, the panel control signal generation circuit 380, the panel power source generation circuit 360, and the grayscale generation circuit 370 shown in FIG. 10 may be deduced with reference to the related description of FIG. 8 and thus is not repeated herein. In the embodiment shown in FIG. 10, based on the timing information provided by the digital control and timing generation circuit 340, the panel control signal generation circuit 380 may generate a scan start pulse STV, a scan clock signal SCK, an emission start pulse ETV, and an emission clock signal ECK to a gate driver 11 and generates a switching signal MUX1 and a switching signal MUX2 to a switching circuit 13.

The gate driver 11 includes a plurality of driving channels. The gate driver 11 may generate a reset signal INIT (e.g., a reset signal $INIT_{ODD}$[N] of a Nth odd reset line and a reset signal $INIT_{EVEN}$[N] of a Nth even reset line), a scan signal SCAN (e.g., a scan line $SCAN_{ODD}$[N] of a Nth odd display line and a scan signal $SCAN_{EVEN}$[N] of a Nth even display line), and an emission signal EMI (e.g., an emission signal $EMI_{ODD}$[N] of a Nth odd emission line and an emission signal $EMI_{EVEN}$[N] of a Nth even emission line) to the sub-pixels of the OLED panel 10. According to design needs, in some embodiments, description of the sub-pixels of the OLED panel 10 shown in FIG. 10 may be deduced with reference to the description related to the sub-pixel circuit shown in FIG. 1 and FIG. 2 and thus is not repeated herein. Description of the OLED panel 10 and the gate driver 11 shown in FIG. 10 may be deduced with reference to the description related to the OLED panel 10 and the gate driver 11 shown in FIG. 6 and thus is not repeated herein.

Figure 11:
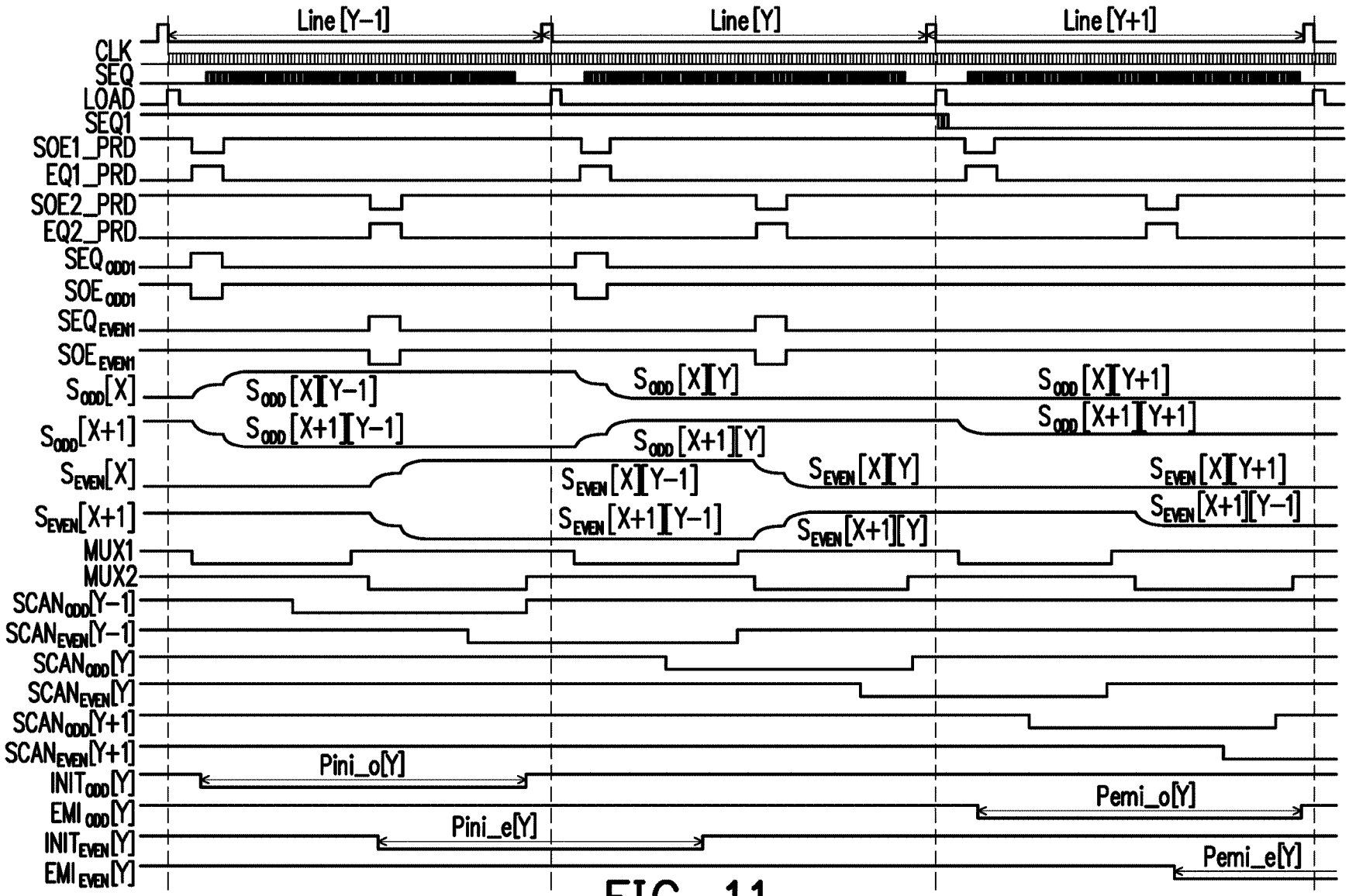
FIG. 11 is a schematic diagram describing waveforms of the signals shown in FIG. 10 according to an embodiment of the disclosure.

FIG. 11 is a schematic diagram describing waveforms of the signals shown in FIG. 10 according to an embodiment of the disclosure. With reference to FIG. 10 and FIG. 11, the horizontal axis shown in FIG. 11 represents time. As shown in FIG. 11, Line[Y−1], Line[Y], and Line[Y+1] respectively represent horizontal periods of a $Y-1^{th}$ display line, a $Y^{th}$ display line, and a $Y+1^{th}$ display line. SCAN[Y−1], SCAN [Y], and SCAN[Y+1] shown in FIG. 11 respectively represent the scan signals SCAN of the $Y-1^{th}$, $Y^{th}$, and $Y+1^{th}$ display lines. $INIT_{ODD}$[Y] shown in FIG. 11 represents a reset signal INIT of the $Y^{th}$ odd display line. $INIT_{EVEN}$[Y] shown in FIG. 11 represents a reset signal INIT of the $Y^{th}$ even display line. $EMI_{ODD}$[Y] shown in FIG. 11 represents an emission signal EMI of the $Y^{th}$ odd display line. $EMI_{EVEN}$ [Y] shown in FIG. 11 represents an emission signal EMI of the $Y^{th}$ even display line. Pini_o[Y] shown in FIG. 11 represents a reset period Pinit of the $Y^{th}$ odd display line. Pini_e[Y] shown in FIG. 11 represents a reset period Pinit of the $Y^{th}$ even display line. Pemi_o[Y−1] shown in FIG. 11 represents an emission period Pemi of the $Y-1^{th}$ odd display line. Pemi_e[Y−1] shown in FIG. 11 represents an emission period Pemi of the $Y-1^{th}$ even display line. $S_{ODD}$[X][Y−1], $S_{ODD}$[X][Y], and $S_{ODD}$[X][Y+1] shown in FIG. 11 respectively represent previous sub-pixel data, current sub-pixel data, and next sub-pixel data of a data line $S_{ODD}$[X]. $S_{ODD}$[X+1][Y−1], $S_{ODD}$[X+1][Y], and $S_{ODD}$[X+1][Y+1] shown in FIG. 11 respectively represent previous sub-pixel data, current sub-pixel data, and next sub-pixel data of a data line $S_{ODD}$[X+1]. $S_{EVEN}$[X][Y−1], $S_{EVEN}$[X][Y], and $S_{EVEN}$ [X][Y+1] shown in FIG. 11 respectively represent previous sub-pixel data, current sub-pixel data, and next sub-pixel data of a data line $S_{EVEN}$[X]. $S_{EVEN}$[X+1][Y−1], $S_{EVEN}$[X+1][Y], and $S_{EVEN}$[X+1][Y+1] shown in FIG. 11 respectively represent previous sub-pixel data, current sub-pixel data, and next sub-pixel data of a data line $S_{EVEN}$[X+1].

The equalization control circuit 310 shown in FIG. 10 includes a data and equalization control circuit 319, a shift register 316, a data latch 317, and a logic circuit 318. The data and equalization control circuit 319 is coupled to the digital control and timing generation circuit 340 to receive a sub-pixel data stream. Based on the sub-pixel data stream, the data and equalization control circuit 319 may check whether sub-pixel data of the first data line $S_{ODD}$[X] and sub-pixel data of the second data line $S_{ODD}$[X+1] meet the predetermined condition, checks whether sub-pixel data of the first data line $S_{EVEN}$[X] and sub-pixel data of the second data line $S_{EVEN}$[X+1] meet the predetermined condition, and sets an equalization control signal SEQ according to the checking result. Description of the data and equalization control circuit 319, the shift register 316, the data latch 317, and the logic circuit 318 shown in FIG. 10 may be deduced with reference to the description of the data and equalization control circuit 315, the shift register 316, the data latch 317, and the logic circuit 318 shown in FIG. 6 and thus is not repeated herein.

The shift register 316 is coupled to the data and equalization control circuit 319 to receive the equalization control signal SEQ, the clock signal CLK, sub-pixel data DATA_O, and sub-pixel data DATA_E. The data latch 317 is coupled to the shift register 316 to receive the equalization control signal SEQ, the sub-pixel data DATA_O, and the sub-pixel data DATA_E. The data latch 317 is further coupled to the data and equalization control circuit 319 to receive the latch signal LOAD, the output enabling clock SOE1_PRD, the output enabling clock SOE2_PRD, the equalization clock EQ1_PRD, and the equalization clock EQ2_PRD.

The source driver circuit 320 shown in FIG. 10 includes a DAC 321, a DAC 322, an output buffer 323, and an output buffer 324. Description of the DAC 321, DAC 322, the output buffer 323, and the output buffer 324 shown in FIG. 10 may be deduced with reference to the related description of FIG. 6 and thus is not repeated herein.

The logic circuit 318 generates switch signals $SEQ_{ODD1}$ and $SOE_{ODD1}$ according to the equalization control signal SEQ1, the output enabling clock SOE1_PRD, the output enabling clock SOE2_PRD, the equalization clock EQ1_PRD, and the equalization clock EQ2_PRD to control the output switching circuit 330. The output switching circuit 330 shown in FIG. 10 includes an output switch $SW_{ODD1}$, an output switch $SW_{ODD2}$, an output switch $SW_{EVEN1}$, and output switch $SW_{EVEN2}$, and equalization switch $SW_{EQ1}$, and an equalization switch $SW_{EQ2}$. The output switch $SW_{ODD1}$ and the output switch $SW_{ODD2}$ are controlled by the switch signal $SOE_{ODD1}$. The output switch $SW_{EVEN1}$ and the output switch $SW_{EVEN2}$ are controlled by the switch signal $SOE_{EVEN1}$. The equalization switch $SW_{EQ1}$ is controlled by the switch signal $SEQ_{ODD1}$. The equalization switch $SW_{EQ2}$ is controlled by the switch signal $SEO_{EVEN1}$. Description of the output switch $SW_{EVEN1}$, the output switch $SW_{EVEN2}$, and the equalization switch $SW_{EQ2}$ may be deduced with reference to the description related to the output switch $SW_{ODD1}$, the output switch $SW_{ODD2}$, and the equalization switch $SW_{EQ1}$ and thus is not repeated herein.

Figure 12:
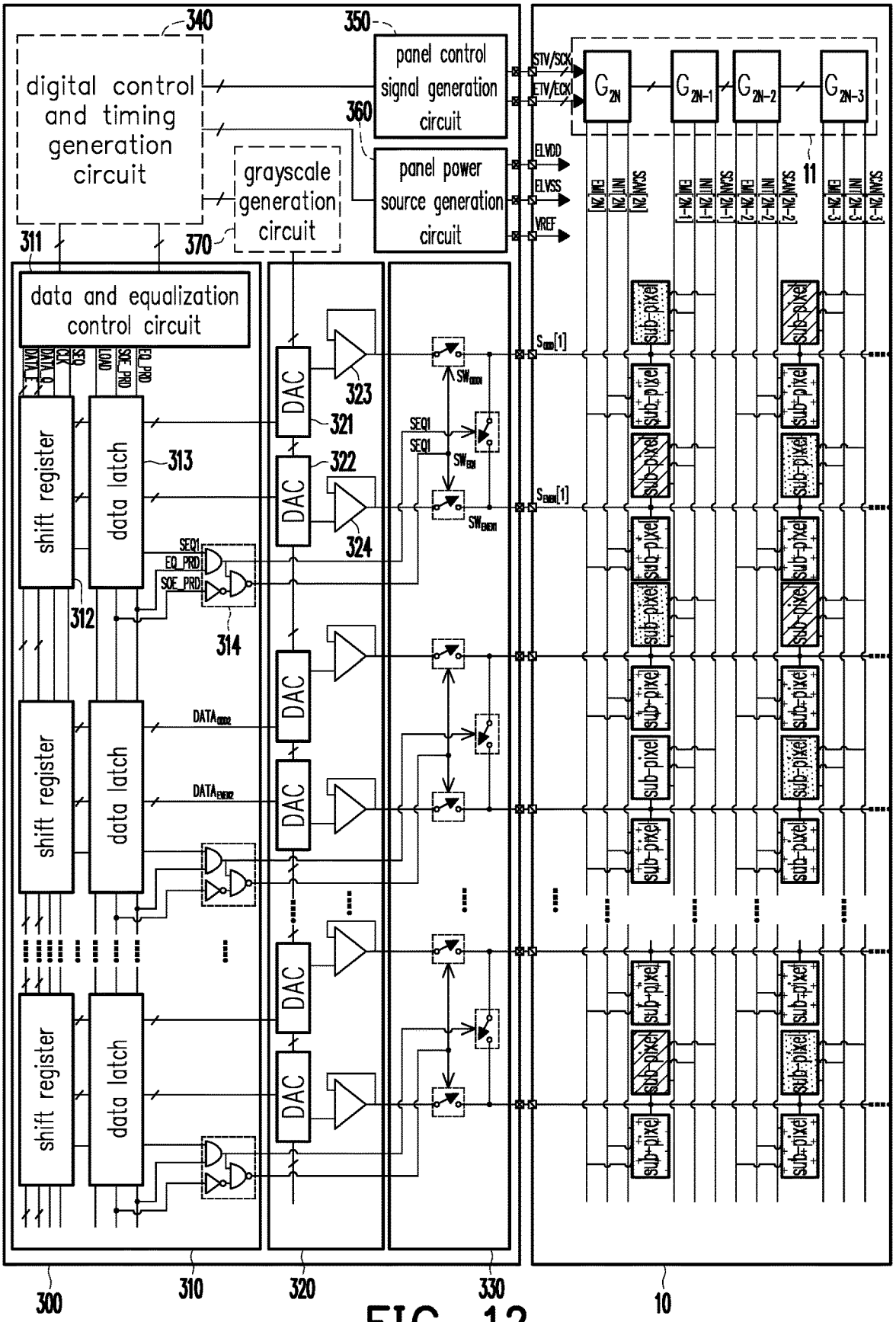
FIG. 12 is a schematic diagram of circuit blocks describing the equalization control circuit, the source driver circuit, and the output switching circuit shown in FIG. 3 according to yet another embodiment of the disclosure.

FIG. 12 is a schematic diagram of circuit blocks describing the equalization control circuit 310, the source driver circuit 320, and the output switching circuit 330 shown in FIG. 3 according to yet another embodiment of the disclosure. The schematic diagram of the waveforms of the signals shown in FIG. 7 may be applied to the embodiments shown by FIG. 12. In the embodiment shown in FIG. 12, the driver device 300 further includes a digital control and timing generation circuit 340, a panel control signal generation circuit 350, a panel power source generation circuit 360, and a grayscale generation circuit 370. Description of the driver device 300, the equalization control circuit 310, the source driver circuit 320, the output switching circuit 330, the digital control and timing generation circuit 340, the panel control signal generation circuit 350, the panel power source generation circuit 360, and the grayscale generation circuit 370 shown in FIG. 12 may be deduced with reference to the description related to the driver device 300, the equalization control circuit 310, the source driver circuit 320, the output switching circuit 330, the digital control and timing generation circuit 340, the panel control signal generation circuit 350, the panel power source generation circuit 360, and the grayscale generation circuit 370 shown in FIG. 6 and thus is not repeated herein.

In the embodiments shown by FIG. 12, the gate driver 11 includes a plurality of driving channels, such as driving channels $G_{2N}$, $G_{2N-1}$, $G_{2N-2}$, and $G_{2N-3}$ shown in FIG. 12. The gate driver 11 may generate a reset signal INIT (e.g., a reset signal INIT[2N] of a $2N^{th}$ reset line, a reset signal INIT[2N−1] of a $2N-1^{th}$ reset line, a reset signal INIT[2N−2] of a $2N-2^{th}$ reset line, and a reset signal INIT[2N−3] of a $2N-3^{th}$ reset line), a scan signal SCAN (e.g., a scan signal SCAN[2N] of a $2N^{th}$ display line, a scan signal SCAN[2N−1] of a $2N-1^{th}$ display line, a scan signal SCAN[2N−2] of a $2N-2^{th}$ display line, and a scan signal SCAN[2N−3] of a $2N-3^{th}$ display line), and an emission signal EMI (e.g., an emission signal EMI[2N] of a $2N^{th}$ emission line, an emission signal EMI[2N−1] of a $2N-1^{th}$ emission line, an emission signal EMI[2N−2] of a $2N-2^{th}$ emission line, and an emission signal EMI[2N−3] of a $2N-3^{th}$ emission line) to the sub-pixels of the OLED panel 10. According to design needs, in some embodiments, description of the sub-pixels of the OLED panel 12 shown in FIG. 10 may be deduced with reference to the description related to the sub-pixel circuit shown in FIG. 1 and FIG. 2 and thus is not repeated herein. Description of the OLED panel 12 and the gate driver 11 shown in FIG. 10 may be deduced with reference to the description related to the OLED panel 10 and the gate driver 11 shown in FIG. 6 and thus is not repeated herein.

According to different design needs, the equalization control circuit 310, the data and equalization control circuit 311, and/or the digital control and timing generation circuit 340 may be implemented in the form of hardware, firmware, software (i.e., a program), or a combination of the majority of the foregoing three.

In the form of hardware, the blocks of the equalization control circuit 310, the data and equalization control circuit 311, and/or the digital control and timing generation circuit 340 may be implemented in the form of a logic circuit on an integrated circuit. Related functions of the equalization control circuit 310, the data and equalization control circuit 311, and/or the digital control and timing generation circuit 340 may be implemented as hardware through using hardware description languages (e.g., Verilog HDL or VHDL) or other suitable programming languages. For instance, the related functions of the equalization control circuit 310, the data and equalization control circuit 311, and/or the digital control and timing generation circuit 340 may be implemented in one or a plurality of controllers, a micro controller, a micro processor, an application-specific integrated circuit (ASIC), a digital signal processor (DSP), a field programmable gate array (FPGA), and/or various logic blocks, modules, and circuits in other processing units.

In the form of software and/or firmware, the related functions of the equalization control circuit 310, the data and equalization control circuit 311, and/or the digital control and timing generation circuit 340 may be implemented as programming codes. For instance, the equalization control circuit 310, the data and equalization control circuit 311, and/or the digital control and timing generation circuit 340 may be implemented by using a general programming language (e.g., C, C++, or an assembly language) or other suitable programming languages. The programming code may be recorded/stored in a recording medium. In some embodiments, the recording medium includes, for example, read only memory (ROM), random access memory (RAM), and/or a storage device. The storage device includes a hard disk drive (HDD) a solid-state drive (SSD), or other storage devices. In some other embodiments, the recording medium may include a "non-transitory computer readable medium". For instance, a tape, a disk, a card, semiconductor memory, a programmable logic circuit, etc. may be used to be implemented as the non-transitory computer readable medium. A controller, a micro controller, or a micro processor may read and execute the programming code from the recording medium to accomplish the related functions of the equalization control circuit 310, the data and equalization control circuit 311, and/or the digital control and timing generation circuit 340.

In view of the foregoing, in the embodiments, the driver device 300 may check whether the sub-pixel data of the first data line and the sub-pixel data of the second data line meet the predetermined condition, so as to further determine whether to perform the equalization operation on the first data line and the second data line according to the checking result. For instance, when the predetermined condition is met, the output switching circuit 330 may perform the equalization operation to reduce the voltage swing caused by the charging and discharging operations performed on the data lines. When the predetermined condition is not met, the output switching circuit 330 does not perform the equalization operation to prevent the overcharging phenomenon from occurring. Hence, the driver device 300 may prevent the overcharging phenomenon caused by the equalization operation from occurring.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A driver device, adapted to drive a light-emitting diode display panel, the driver device comprising:

a source driver circuit;

an output switching circuit, having a first input end coupled to a first output end of the source driver circuit, wherein a second input end of the output switching circuit is coupled to a second output end of the source driver circuit, a first output end of the output switching circuit is adapted to be coupled to a first data line of the light-emitting diode display panel, a second output end of the output switching circuit is adapted to be coupled to a second data line of the light-emitting diode display panel, and the output switching circuit is capable of performing an equalization operation on the first data line and the second data line; and an equalization control circuit, configured for checking whether sub-pixel data of the first data line and sub-pixel data of the second data line meet a predetermined condition and to determine whether to control the output switching circuit to perform the equalization operation on the first data line and the second data line in a data scanning period after a reset period according to result of the checking, wherein a plurality of sub-pixels of the light-emitting diode display panel located on a current display line of the light-emitting diode display panel are reset in the reset period.

2. The driver device according to claim 1, wherein the light-emitting diode display panel comprises a plurality of display sub-pixels, each of the display sub-pixels comprises a storage capacitor for storing charges of sub-pixel data, and the predetermined condition is configured to prevent the storage capacitor from being excessive charged.

3. The driver device according to claim 1, wherein the sub-pixel data of the first data line to be checked comprises previous sub-pixel data and current sub-pixel data of the first data line, the sub-pixel data of the second data line to be checked comprises previous sub-pixel data and current sub-pixel data of the second data line, and the equalization operation is performed on the first data line and the second data line in the data scanning period corresponding to the current display line of the light-emitting diode display panel.

4. The driver device according to claim 3, wherein the predetermined condition comprises:

whether a direction from a first previous voltage level corresponding to the previous sub-pixel data of the first data line towards an equalized level of the first data line and the second data line is consistent with a direction from the first previous voltage level corresponding to the previous sub-pixel data of the first data line towards a first current voltage level corresponding to the current sub-pixel data of the first data line, and whether a direction from a second previous voltage level corresponding to the previous sub-pixel data of the second data line towards the equalized level of the first data line and the second data line is consistent with a direction from the second previous voltage level corresponding to the previous sub-pixel data of the second data line towards a second current voltage level corresponding to the current sub-pixel data of the second data line.

5. The driver device according to claim 3, wherein when the previous sub-pixel data of the first data line is greater than the previous sub-pixel data of the second data line, when the current sub-pixel data of the first data line is less than a mean of the previous sub-pixel data of the first data line and the previous sub-pixel data of the second data line, and when the current sub-pixel data of the second data line is greater than the mean, the equalization control circuit is configured to control the output switching circuit to perform the equalization operation, and when the previous sub-pixel data of the first data line is less than the previous sub-pixel data of the second data line, when the current sub-pixel data of the first data line is greater than the mean, and when the current sub-pixel data of the second data line is less than the mean, the equalization control circuit is configured to control the output switching circuit to perform the equalization operation.

6. The driver device according to claim 1, wherein the output switching circuit comprises:

a first output switch, having a first end coupled to the first output end of the source driver circuit, wherein a second end of the first output switch is adapted to be coupled to the first data line of the light-emitting diode display panel;

a second output switch, having a first end coupled to the second output end of the source driver circuit, wherein a second end of the second output switch is adapted to be coupled to the second data line of the light-emitting diode display panel; and an equalization switch, having a first end and a second end respectively coupled to the second end of the first output switch and the second end of the second output switch.

7. The driver device according to claim 6, wherein when the equalization control circuit determines to control the output switching circuit to perform the equalization operation in the data scanning period, the equalization control circuit determines to control the first output switch and the second output switch to be turned off and the equalization switch to be turned on in a first sub-period of the data scanning period, and the equalization control circuit determines to control the first output switch and the second output switch to be turned on and the equalization switch to be turned off in a second sub-period of the data scanning period after the first sub-period.

8. The driver device according to claim 6, wherein the equalization control circuit continuously turns off the equalization switch in the data scanning period when the equalization control circuit determines not to control the output switching circuit to perform the equalization operation in the data scanning period.

9. The driver device according to claim 1, wherein the equalization control circuit comprises:

a data and equalization control circuit, configured to receive a sub-pixel data stream, check whether sub-pixel data of the first data line and sub-pixel data of the second data line meet the predetermined condition, and set an equalization control signal according to the result of the checking;

a shift register, coupled to the data and equalization control circuit to receive the equalization control signal;

a data latch, coupled to the shift register to receive the equalization control signal; and a logic circuit, coupled to the data latch to receive the equalization control signal, wherein the logic circuit controls the output switching circuit according to the equalization control signal.

10. The driver device according to claim 9, wherein the logic circuit is further coupled to the data and equalization control circuit to receive an output enabling clock and an equalization clock.

11. An operation method of a driver device, the driver device adapted to drive a light-emitting diode display panel, the operation method comprising:

performing an equalization operation on a first data line of the light-emitting diode display panel and a second data line of the light-emitting diode display panel by an output switching circuit of the driver device, the a first input end of the output switching circuit is coupled to a first output end of a source driver circuit of the driver device, a second input end of the output switching circuit is coupled to a second output end of the source driver circuit, a first output end of the output switching circuit is adapted to be coupled to the first data line, and a second output end of the output switching circuit is adapted to be coupled to the second data line;

checking whether sub-pixel data of the first data line and sub-pixel data of the second data line meet a predetermined condition by an equalization control circuit of the driver device;

resetting a plurality of sub-pixels of the light-emitting diode display panel located on a current display line of the light-emitting diode display panel in a reset period; and determining whether to control the output switching circuit to perform the equalization operation on the first data line and the second data line in a data scanning period according to the result of the checking after the reset period by the equalization control circuit.

12. The operation method according to claim 11, wherein the light-emitting diode display panel comprises a plurality of display sub-pixels, each of the display sub-pixels comprises a storage capacitor for storing charges of sub-pixel data, and the predetermined condition is configured to prevent the storage capacitor from being excessive charged.

13. The operation method according to claim 11, wherein the sub-pixel data of the first data line to be checked comprises previous sub-pixel data and current sub-pixel data of the first data line, the sub-pixel data of the second data line to be checked comprises previous sub-pixel data and current sub-pixel data of the second data line, and the equalization operation is performed on the first data line and the second data line in the data scanning period corresponding to the current display line of the light-emitting diode display panel.

14. The operation method according to claim 13, wherein the predetermined condition comprises:

whether a direction from a first previous voltage level corresponding to the previous sub-pixel data of the first data line towards an equalized level of the first data line and the second data line is consistent with a direction from the first previous voltage level corresponding to the previous sub-pixel data of the first data line towards a first current voltage level corresponding to the current sub-pixel data of the first data line, and whether a direction from a second previous voltage level corresponding to the previous sub-pixel data of the second data line towards the equalized level of the first data line and the second data line is consistent with a direction from the second previous voltage level corresponding to the previous sub-pixel data of the second data line towards a second current voltage level corresponding to the current sub-pixel data of the second data line.

15. The operation method according to claim 13, further comprising:

when the previous sub-pixel data of the first data line is greater than the previous sub-pixel data of the second data line, when the current sub-pixel data of the first data line is less than a mean of the previous sub-pixel data of the first data line and the previous sub-pixel data of the second data line, and when the current sub-pixel data of the second data line is greater than the mean, controlling the output switching circuit to perform the equalization operation by the equalization control circuit, and when the previous sub-pixel data of the first data line is less than the previous sub-pixel data of the second data line, when the current sub-pixel data of the first data line is greater than the mean, and when the current sub-pixel data of the second data line is less than the mean, controlling the output switching circuit to perform the equalization operation by the equalization control circuit.

16. The operation method according to claim 11, further comprising:

when the equalization control circuit determines to control the output switching circuit to perform the equalization operation in the data scanning period, determining to turn off the a first output switch and a second output switch of the output switching circuit and turn on an equalization switch of the output switching circuit in a first sub-period of the data scanning period by the equalization control circuit, wherein a first end of the first output switch is coupled to the first output end of the source driver circuit, a second end of the first output switch is adapted to be coupled to the first data line, a first end of the second output switch is coupled to the second output end of the source driver circuit, a second end of the second output switch is adapted to be coupled to the second data line, and a first end and a second end of the equalization switch are respectively coupled to the second end of the first output switch and the second end of the second output switch; and turning on the first output switch and the second output switch and turning off the equalization switch during a second sub-period of the data scanning period after the first sub-period.

17. The operation method according to claim 16, further comprising:

continuously turning off the equalization switch in the data scanning period by the equalization control circuit when the equalization control circuit determines not to control the output switching circuit to perform the equalization operation in the data scanning period.

18. The operation method according to claim 11, further comprising:

receiving a sub-pixel data stream by a data and equalization control circuit of the equalization control circuit;

checking whether sub-pixel data of the first data line and sub-pixel data of the second data line meet the predetermined condition by the data and equalization control circuit;

setting an equalization control signal according to the result of the checking by the data and equalization control circuit; and controlling the output switching circuit according to the equalization control signal by a logic circuit of the equalization control circuit.

* * * * *